US006794828B2

(12) United States Patent
Tyson

(10) Patent No.: US 6,794,828 B2
(45) Date of Patent: Sep. 21, 2004

(54) DRIVING SERIALLY CONNECTED HIGH INTENSITY DISCHARGE LAMPS

(75) Inventor: Lawrence Samuel Tyson, Sutton (GB)

(73) Assignee: MicroLights Limited, Marlborough (GB)

( * ) Notice: Subject to any disclaimer, the term of this patent is extended or adjusted under 35 U.S.C. 154(b) by 0 days.

(21) Appl. No.: 10/221,298

(22) PCT Filed: Mar. 8, 2001

(86) PCT No.: PCT/GB01/01005

§ 371 (c)(1),
(2), (4) Date: Oct. 22, 2002

(87) PCT Pub. No.: WO01/67829

PCT Pub. Date: Sep. 13, 2001

(65) Prior Publication Data

US 2003/0117089 A1 Jun. 26, 2003

(30) Foreign Application Priority Data

Mar. 10, 2000 (GB) ..... 0005879

(51) Int. Cl.[7] ..... H05B 37/00

(52) U.S. Cl. ..... 315/244; 315/307; 315/291; 315/312; 315/324; 315/DIG. 7

(58) Field of Search ..... 315/209 R, 246, 315/291, 307, 244, 224, 205, 312, 324, DIG. 5, DIG. 7

(56) References Cited

U.S. PATENT DOCUMENTS

| | | | | |
|---|---|---|---|---|
| 4,904,903 A | | 2/1990 | Pacholok | 315/209 R |
| 5,677,602 A | | 10/1997 | Redl | 315/224 |
| 5,828,185 A | | 10/1998 | Fellows | 315/246 |
| 5,900,701 A | | 5/1999 | Guhilot | 315/307 |
| 5,982,109 A | | 11/1999 | Konopka | 315/209 R |
| 5,986,412 A | * | 11/1999 | Collins | 315/291 |
| 5,998,939 A | | 12/1999 | Fellows | 315/246 |
| 6,094,017 A | * | 7/2000 | Adamson | 315/307 |
| 6,160,362 A | * | 12/2000 | Shone et al. | 315/308 |
| 6,384,544 B1 | * | 5/2002 | Greenwood et al. | 315/291 |
| 6,590,350 B1 | * | 7/2003 | Tyson | 315/291 |

FOREIGN PATENT DOCUMENTS

| | | |
|---|---|---|
| DE | 19829600 | 9/1999 |
| GB | 1577520 | 10/1980 |
| GB | 2074801 | 11/1981 |
| WO | 9935890 | 7/1999 |

* cited by examiner

*Primary Examiner*—Haissa Philogene
(74) *Attorney, Agent, or Firm*—Merchant & Gould, P.C.

(57) ABSTRACT

A lighting system (1) comprises a plurality of high intensity discharge lamps (9, 39, 6) and an electronic control (2) having a power input (4), an alternating current power output regulator (22), and an alternating power output (3) having an output frequency arranged to be variable within an output frequency range, the output having a first and a second output line. The lamps are connected in series with each other so that the first line is connected to the first electrode (11) of the first of the lamps, the second electrode (12) of the first of the lamps is connected to the first electrode (41) of the next lamp in the series, the second electrode (13) of the final lamp in the series being connected to the second output line. The lamps have an acoustic resonant frequency range and the output frequency range of the control is arranged to be above the acoustic resonant frequency range.

15 Claims, 12 Drawing Sheets

DRIVING SERIALLY CONNECTED HIGH INTENSITY DISCHARGE LAMPS

CROSS-REFERENCE TO RELATED APPLICATIONS

This application claims priority under 35 U.S.C. §371 to PCT/GB01/01005, filed Mar. 8, 2001, in the United Kingdom.

The present invention relates to high intensity discharge lighting systems, and to high intensity discharge lamps and controls therefor.

BACKGROUND OF THE INVENTION

High intensity discharge lighting systems comprising a high intensity discharge lamp and a control for regulating the electrical power to the lamp are known. In this specification, references to "high intensity discharge lamps" are to lamps having a sealed envelope containing at least two electrodes for an electrical discharge, and are arranged to be used for lighting when an arc is established across the electrodes. Such lamps have a high impedance before they are lit, and a low impedance while they are lit. Before the lamp is lit, it is necessary to apply a high voltage (typically 2–5 kV) across the lamp to start the lamp to conduct electricity. High intensity discharge lamps are characterised by a short arc length, typically less than 20 mm for a 70 watt lamp, and typically have a high internal pressure when hot. The envelope is filled with fill materials that may not be fully evaporated and hence have a low pressure when the lamp is cold and before the lamp has started conducting. However, when the lamp is operating and is hot, the said fill materials have a high pressure. High intensity discharge lamps are further characterised in that as a result of this increase in pressure of the fill material an ignition voltage required to start such lamps may increase sharply as the lamp becomes hot. For example, a lamp with a cold ignition voltage of 2,000 volts may when hot require an ignition voltage of 30,000 volts to restart the lamp. Additional electrodes may be provided in such lamps for particular applications to meet particular operating requirements.

Such known controls may comprise an electro-magnetic inductance to regulate the power, and a capacitor and switch arrangement to generate the high starting voltage. Such electromagnetic controls provide an electrical output to the lamp at the same frequency as the electrical supply to the control. Alternatively, electronic controls are known, where an electronic circuit is arranged to provide both the regulation and generate the high starting voltage. Such electronic controls normally provide an electrical output to the lamp at a higher frequency than that of the electrical supply to the control. Typical electronic controls for operating a high intensity discharge lamp produce a square wave voltage output at a frequency of up to 400 Hz with an electrical supply having a sinusoidal waveform and a frequency of 50 Hz or 60 Hz. These are hereinafter referred to as "square wave" technology controls.

The arrangement for producing a high voltage for starting or igniting the lamp, being known hereinafter as an "ignitor", and the means for regulating the power when the lamp is operating in the lit state to provide a desired operating power for the lamp being known hereinafter as a "ballast".

In electronic controls known means to generate high voltage includes resonant circuits and suddenly discharged capacitor circuits. Known electronic controls having a self oscillating circuit operate at a frequency determined by the resonance of power handling components in the control circuit. A benefit of these self oscillating circuits is simplicity and low cost, however a disadvantage is that it is difficult to vary the operating frequency of such a control circuit as the operating frequency is determined solely by the values of fixed components, the values of which are determined by the power of the circuit it is arranged to control. Also known are electronic controls where the operating frequency is determined solely by a frequency generator such that the operating frequency can be arranged to be independent of the characteristics of power handling components in the circuit.

The electronic controls employed to date have, as a result of their complexity, a disadvantage of cost that has prevented their widespread use.

One of the reasons for the complex design of square wave technology controls, (which operate lamps at relatively low frequencies 50–400 Hz for example), is that discharge lamps exhibit undesirable instabilities when operated in the frequency range of 1 kHz–300 kHz depending on lamp type and geometry. Consequently, elaborate electronic topologies are required to generate low frequencies with power levels and control characteristics suited to discharge lamps.

Should the operating frequency (or some harmonic or sub harmonic of the operating frequency) be such as to excite standing waves of pressure within a lamp then undesirable movement or even extinction of the arc can occur. This can be damaging to the lamp since arc movement can cause the arc to impinge upon an inner surface of the envelope forming burner walls with consequent lamp failure. At the very least, these movements of the arc spoil the quality of illumination obtained.

The above mentioned instability and standing waves of pressure are manifestations of a phenomenon known as "acoustic resonance". Acoustic resonance arises as a result of pressure variations in the lamp caused by the operating frequency or some harmonic or sub harmonic of the operating frequency. A lamp has an acoustic resonant frequency range that is the range of frequencies which will excite acoustic resonance within the lamp. Hence a particular lamp would be likely to exhibit acoustic resonance when operated with a power input frequency within the acoustic resonant frequency range.

For a particular lamp, the acoustic resonance conditions during the starting of the lamp will be different to those when the lamp is operating in a stable lit condition. Since the starting of the lamp is a transient phase of operation lasting a very short time interval such acoustic resonance phenomena that might otherwise occur during this transient phase do not normally have time to become established. Hence the acoustic resonant frequency range is defined with reference only to the conditions when the lamp is operating in a stable lit condition.

A high intensity discharge lighting system having a control and at least two high intensity discharge lamps is described in U.S. Pat. No. 5,986,412 to Collins. FIG. 1 of Collins' Patent shows that the operation of the two lamps 12 and 14 is by means of an electromagnetic control, referred to as ballast circuit 10 which has a shared portion of the circuit comprising principally transformer 16, and two ignitor pulse circuits 30 and 50 for starting lamps 12 and 14 respectively. In operation lamp 12 must start before lamp 14 in order to conduct the electrical power necessary to operate the second ignitor pulse circuit 50. A disadvantage of the Collins system is that it is necessary to duplicate the ignitor circuit.

U.S. Pat. No. 5,982,109 to Konopka shows in his FIG. 4 two lamps 10 and 20 connected to an electronic control 120, and in FIG. 6 two lamps 10 and 20 connected to a control 160. In each case the lamps are connected in parallel current paths, and the only shared part of the control is the inverter 200, each lamp having its own output circuit 300, 500 and 400, 600 inductor 310, 510 and 410, 610 and other ignitor components. The Konopka arrangement has similar disadvantages to the Collins system in that it requires considerable duplication of expensive components.

U.S. Pat. No. 5,900,701 to Guhilot in FIG. 4C shows a plurality of lamps 16 connected in parallel across a secondary winding 111 of an inverter transformer 115. For each lamp so connected it is necessary to duplicate a ballast filter comprising capacitor 112 and inductor 113. A reason that it is necessary to duplicate the ballast filter components is to ensure stable and safe operation of each lamp, since being in parallel if one lamp failed to start all the output power from the transformer would pass through the single lit lamp. Hence, as in the previous examples duplication of expensive components is required.

U.S. Pat. Nos. 5,828,185 and 5,998,939 to Philips Electronics in FIG. 8 shows two light emitting elements, a first and a second discharge devices 3 connected electrically in series within a common outer bulb (column 12, line 20). A reason for combining two discharge devices in this patent is to overcome a disadvantage of the patent in that to achieve operation of the lamps below a lamp resonant frequency that would excite acoustic resonance, the size of the discharge devices must be such that the lowest lamp resonant frequency must be higher than the output frequency of the ballast. By limiting the physical size of the lamps, the maximum obtainable light output is also limited, and in Philips the power is limited to 20W. This is a severe restriction since the most commonly used high intensity discharge lamps are in the range of 35W to 150W. Further there are significant manufacturing difficulties to be overcome in the manufacture of small high intensity discharge lamps, as generally the fill within the discharge device must be at a much greater pressure in order to achieve suitable electrical discharge characteristics. The use of multiple discharge devices within one common outer bulb is also disadvantageous in that there is no longer a single light emitting point, and it may not be possible to achieve a desired focused lighting effect with a reflector.

None of the above patents disclose or teach the use of a control where there is no duplication of control components to enable the operation of a plurality of commercially available high intensity discharge lamps from the one control. Neither do any of the above patents disclose or teach means to ensure balanced operation of two lamps in series, or means to monitor the operation of lamps in series to enhance the safety of the lighting system.

BRIEF SUMMARY OF THE INVENTION

According to one aspect of the invention there is provided a lighting system comprising at least:

(a) a plurality of high intensity discharge lamps, each of the high intensity discharge lamps comprising a sealed envelope containing at least a first and a second electrode for an electrical discharge, (b) the lamps having an acoustic resonant frequency range, (c) an electronic control having a power input, an alternating current power output regulator, and an alternating power output having an output frequency arranged to be variable within an output frequency range, the output having a first and a second output line, (d) the lamps being connected in series with each other so that the first line is connected to the first electrode of the first of the lamps, the second electrode of the first of the lamps is connected to the first electrode of the next lamp in the series, the second electrode of the final lamp in the series being connected to the second output line, and (e) the output frequency range being above the acoustic resonant frequency range.

A benefit of this lighting system is that it is not necessary to duplicate any components within the control, and hence a cost saving may be obtained while using commercially available standard high intensity discharge lamps.

A benefit of the output frequency range being above the acoustic resonant frequency range is that when the lamp is operating in a stable lit condition, the output frequency may be above an upper limit frequency which will excite acoustic resonance at the upper limit frequency. This improves the stability of the lamp operation.

Preferably, the control comprises a ballast and an ignitor, the ignitor having an ignition capacitance in a parallel current path with the lamps, the ignition capacitance being arranged in resonant circuit having a fundamental resonant frequency.

In an embodiment of the invention, preferably the control is provided with a switch to disconnect the ignition capacitor when the lamps are lit.

A benefit of disconnecting the ignition capacitor is that the efficiency of the control may be improved. A further benefit being that the ignition capacitor may be arranged to be resonant at a fundamental resonant frequency, and hence the ignition capacitance may be relatively large, providing a high energy high voltage starting or ignition condition.

In an alternative embodiment, preferably the ignition capacitance is arranged such that resonance occurs at a frequency above that used to provide a high voltage for igniting the lamps. More preferably, the ignition capacitance is arranged to resonate at the fundamental frequency when a particular output frequency within the output frequency range is at a third harmonic of the fundamental frequency.

A benefit of the resonance occurring at the third harmonic is that losses arising from a current drawn by the capacitor during the operation of the lamp when lit are reduced. A further benefit of the ignition capacitance being arranged to resonate when a particular output frequency is at a third harmonic of the fundamental resonant frequency and within the output frequency range is that a value of the ignition capacitance is sufficiently small that the capacitance does not require disconnection when the lamps are lit and that a current drawn during an ignition resonance is also reduced, and hence switching components in the control may be smaller.

Preferably, in an embodiment of the invention, a capacitor is connected in a parallel path separately with each lamp. Preferably, said capacitor is a portion of the ignition capacitance.

Preferably, in an alternative embodiment of the invention, a resistor is connected in parallel with each lamp.

A benefit of connecting a capacitor or a resistor in parallel with each lamp is that any imbalance between the power used by each lamp may be minimised. A further benefit is that safety may be improved since a failure mode caused by running a lamp above its intended power rating is that of explosion.

Preferably, the control is arranged to monitor a mid-point voltage level between an adjacent pair of lamps.

A benefit of this is that the mid-point voltage level measured at a point between the two lamps may be used to indicate the relative power consumption of each lamp.

Preferably, the control is arranged to power down when a measured value of the mid-point voltage level is outside a permissible range of values.

A benefit of the control being arranged to power down is that the control may be arranged to stop operating when a lamp is about to fail.

Preferably, the control has indicator means arranged to indicate which lamp has an arc voltage outside of a permissible range of arc voltage.

Preferably, the control has indicator means arranged to indicate which lamp has the lower arc voltage.

Preferably, the control has indicator means arranged to indicate which lamp has the higher arc voltage.

A benefit of this is that arc voltage may be used as an indicator of incipient lamp failure, or of a lamp that has failed. By way of example, a lamp that has failed to light will have the whole output voltage across it, while a lamp which has lost fill pressure will probably have a lower arc voltage. A further benefit is that should the control also be arranged to power down in the event of incipient lamp failure, indicator means will enable the faulty bulb to be replaced without requiring further investigations.

Preferably, the regulated alternating current power output for powering the lamps has an output frequency greater than a frequency of a power supply to the ballast.

Preferably, the control has a direct current to alternating current converter producing the regulated alternating current power output for powering the lamps, the control having an output frequency range above 300 kHz.

More preferably, the alternating current output of the control for powering the lamps has an output frequency range above 400 kHz.

A benefit of a frequency range above 300 kHz is that operation of the lamp may be further improved, and yet further improvements may be obtained by operation above 400 kHz.

Preferably, the output frequency range is entirely above the upper limit frequency of the acoustic resonant frequency range of the lamps.

A benefit of powering the lamps at a frequency above the upper limit frequency of the acoustic resonant frequency range of the lamps is that a more stable operation and a better quality of illumination is obtained. A further benefit of operating above the upper limit frequency of the acoustic resonant frequency range is that this does not place a constraint on the maximum size of the sealed envelope or burner.

Preferably, the alternating current output of the control for powering the lamps has a sinusoidal waveform.

A benefit of a sinusoidal waveform output to the lamps is that problems arising from harmonics present when a square wave waveform output is used may be avoided.

A further benefit of operation at high frequency is that the efficiency of the control may be further improved.

BRIEF DESCRIPTION OF THE DRAWINGS

Specific embodiments of the invention will now be described by way of example with reference to the accompanying drawings in which.

DETAILED DESCRIPTION OF THE INVENTION

Figure 1:
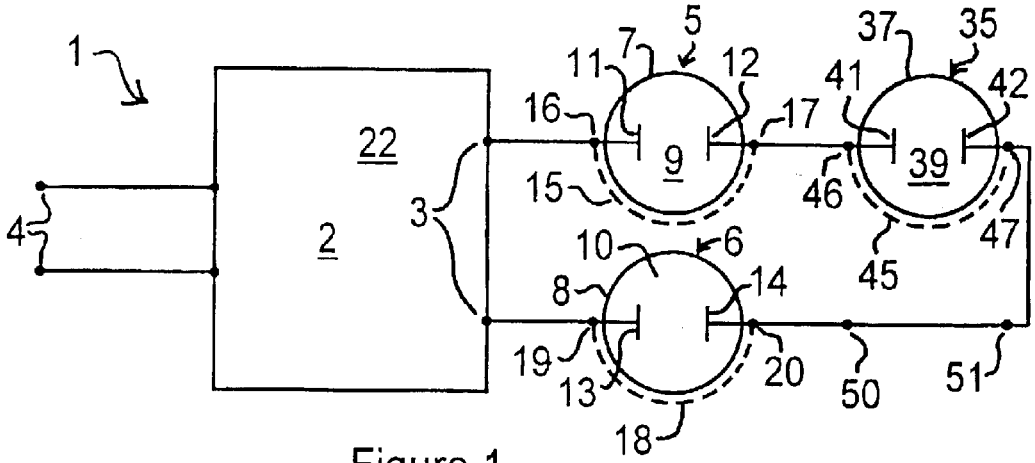
FIG. 1 is a circuit diagram of a lighting system of a first embodiment of the invention.

From FIG. 1, a lighting system 1 according to a first embodiment of the invention is shown. The lighting system 1 having an electronic control 2 with an alternating current power output regulator 22 arranged to regulate a regulated alternating current power output 3 connected to three high intensity discharge lamps 5, 6 and 35, the lamps being connected in series with each other across the power output 3. The control 2 has a power supply 4 from a suitable alternating current or direct current source. Each of the high intensity discharge lamps 5, 6 and 35 comprise respectively a sealed envelope 7, 8 and 37 containing at least two electrodes 11, 12, 13, 14, 41 and 42 for an electrical discharge, each envelope also having a fill 9, 10 and 39. The fill 9, 10 and 39 may be only partially evaporated at ambient temperature. Lampholders 15, 18 and 45 are provided, with connections 16 and 17, 19 and 20, and 46 and 47 respectively to facilitate removal and replacement of the lamps. Preferably, the lamps 5, 6 and 35 have the same power rating within normal manufacturing tolerances. Further lamps may be placed in series with those shown by breaking the circuit at points 50 and 51 and inserting further lampholders and lamps of the same power rating as the other lamps.

Figure 2:
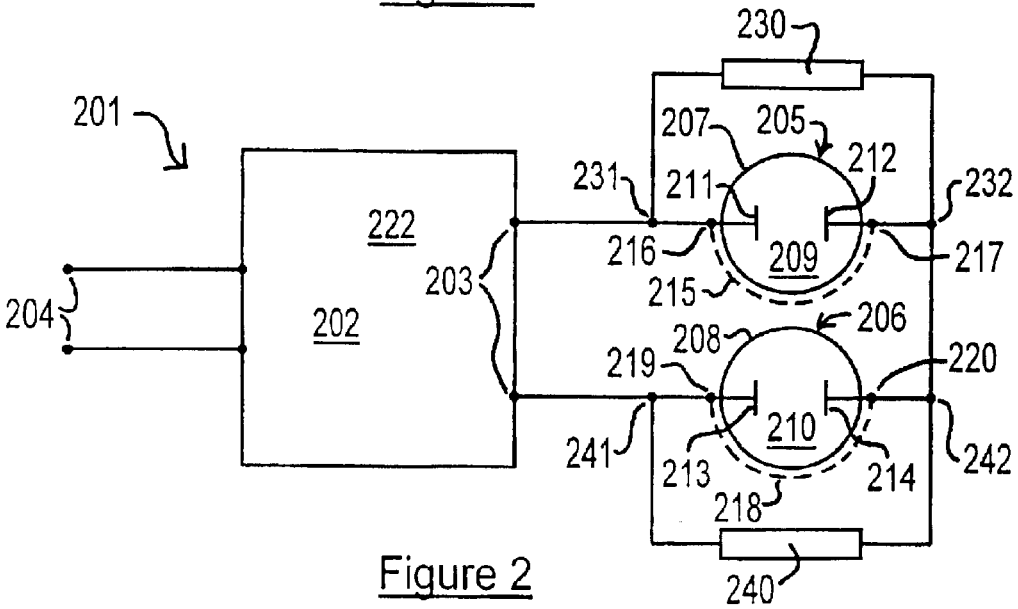
FIG. 2 is a circuit diagram of a lighting system of a second embodiment of the invention.

From FIG. 2, a lighting system 201 according to a second embodiment the invention is shown. The lighting system 201 having an electronic control 202 with an alternating current power output regulator 222 arranged to regulate with a regulated alternating current power output 203 connected to two high intensity discharge lamps 205 and 206, the lamps being connected in series with each other across the power output 203. The control 202 has a power supply 204 from a suitable alternating current or direct current source. Each of the high intensity discharge lamps 205 and 206 comprise a sealed envelope 207 and 208 containing at least two electrodes 211, 212, 213, and 214 for an electrical discharge, each envelope also having a fill 209 and 210. The fill 209 and 210 may be only partially evaporated at ambient temperature. Lampholders 215 and 218 are provided, with connections 216 and 217, and 219 and 220 respectively to facilitate removal and replacement of the lamps. A resistor 230 and 240 is connected in parallel with each of the lamps 205 and 206 at connections 231 and 232 and 242 and 241 respectively. Preferably, the lamps 205 and 206 have the same power rating within normal manufacturing tolerances.

A benefit of fitting the resistors 230 and 240 in the lighting circuit of FIG. 2, is that should the voltage rise across one lamp and fall across the other lamp, a resulting slight imbalance of the voltage across each of the lamps 205 and 206 will tend to be corrected by a current flowing through the resistors. Correction of the imbalance of voltage ensures that the lamps operate at as nearly as possible identical power levels. A benefit of correcting un-matched power outputs is that a risk of the two lamps emitting different levels of illumination or different colour spectra, and premature failure of one of the lamps may be reduced.

Although only two lamps are shown in FIG. 2, as described with reference to FIG. 1 further lamps and in this embodiment, their associated resistors may be added in series with those shown. The benefits of this embodiment may still be obtained with these further lamps.

Figure 3:
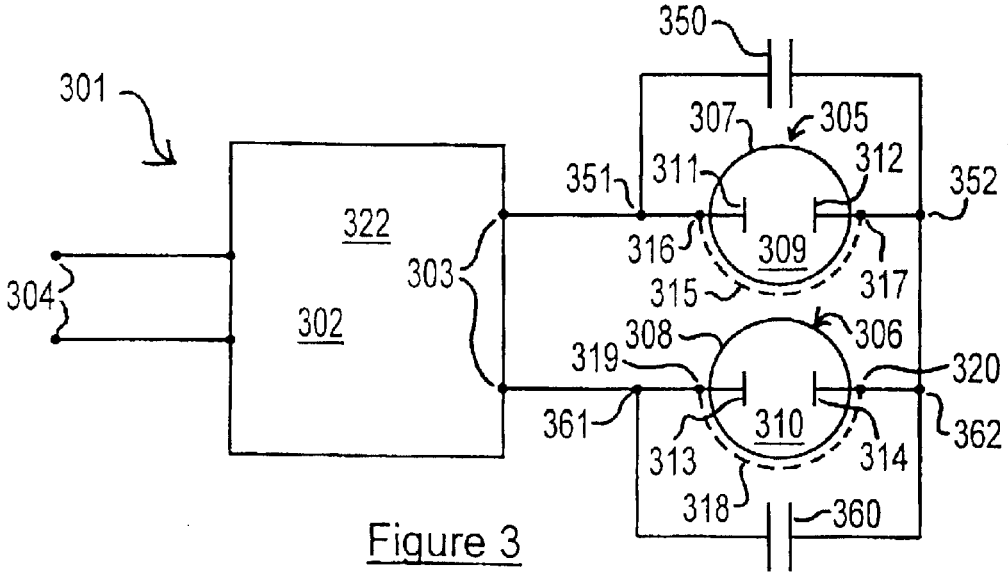
FIG. 3 is a circuit diagram of a lighting system with an electronic control of a third embodiment of the invention.

From FIG. 3 a lighting system 301 according to a third embodiment of the invention is shown. The lighting system 301 having an electronic control 302 with an alternating current power output regulator 322 arranged to regulate with a regulated alternating current power output 303 connected to two high intensity discharge lamps 305 and 306, the lamps being connected in series with each other across the power output 303. The control 302 has a power supply 304 from a suitable alternating current or direct current source. Each of the high intensity discharge lamps 305 and 306 comprises a sealed envelope, 307 and 308, containing at least two electrodes 311, 312, 314, and 313 for an electrical discharge, each envelope also having a fill, 309 and 310. The fill, 309 and 310, may be only partially evaporated at ambient temperature. Lampholders 315 and 318 are provided, with connections 316 and 317, and 320 and 319 respectively to facilitate removal and replacement of the lamps. A capacitor 350 and 360 is connected in parallel with each of the lamps 305 and 306 at connections 351 and 352 and 362 and 361 respectively. Preferably, the lamps 305 and 306 have the same power rating within normal manufacturing tolerances.

A benefit of fitting the capacitors 350 and 360 in the lighting circuit of FIG. 3, is that should the voltage rise across one lamp and fall across the other lamp, a resulting slight imbalance of the voltage across each of the lamps 305 and 306 will tend to be corrected by a current flowing through the capacitors. Correction of the imbalance of voltage ensures that the lamps operate at as nearly as possible identical power levels. Failure to correct un-matched power outputs may result in the two lamps emitting different levels of illumination or different colour spectra, and may also result in the premature failure of one of the lamps.

Although only two lamps are shown in FIG. 3, as described with reference to FIG. 1 further lamps and, in this embodiment, their associated capacitors may be added in series with those shown. The benefits of this embodiment may still be obtained with these further lamps.

Figure 4:
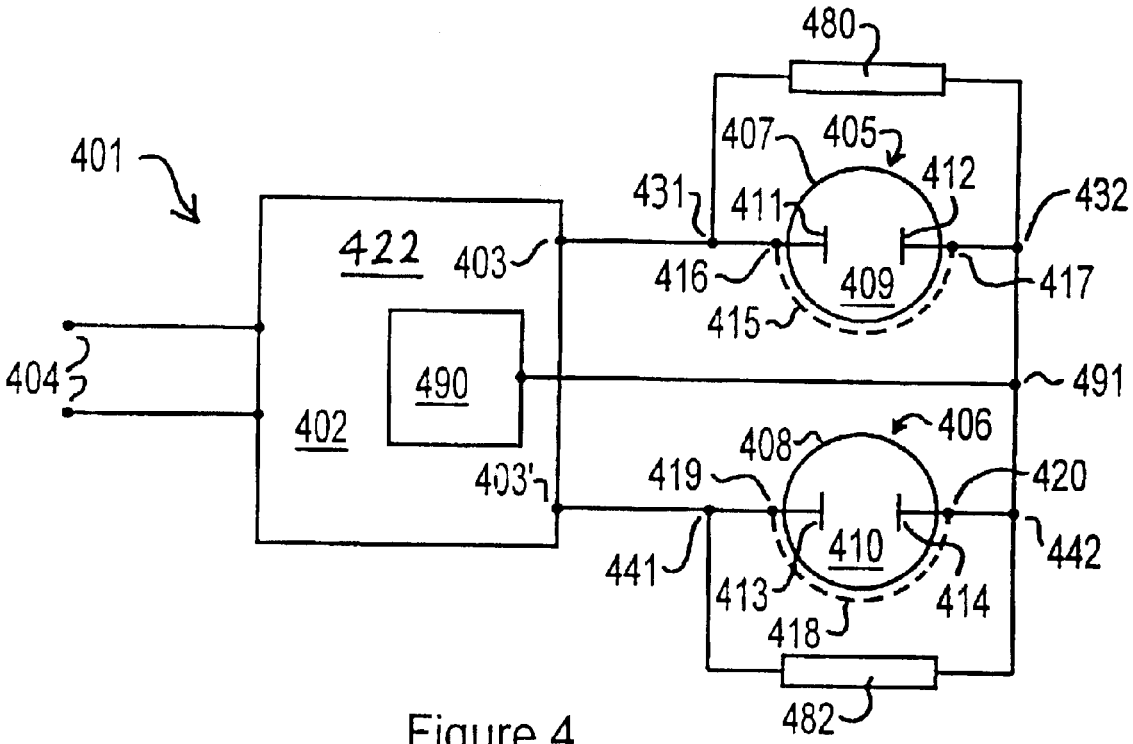
FIG. 4 is a circuit diagram of a lighting system of a fourth embodiment of the invention.

From FIG. 4 a lighting system 401 according to a fourth embodiment the invention is shown. The lighting system 401 having an electronic control 402 with an alternating current power output regulator 422 arranged to regulate with a regulated alternating current power output 403 and 403' connected to two high intensity discharge lamps 405 and 406, the lamps being connected in series with each other across the power output 403 and 403'. The control 402 has a power supply 404 from a suitable alternating current or direct current source. Each of the high intensity discharge lamps 405 and 406 comprise a sealed envelope 407 and 408 containing at least two electrodes 411, 412, 414, and 413 for an electrical discharge, each envelope also having a fill 409 and 410. The fill 409 and 410 may be only partially evaporated at ambient temperature. Lampholders 415 and 418 are provided, with connections 416 and 417, and 420 and 419 respectively to facilitate removal and replacement of the lamps. An impedance, preferably a resistor or a capacitor 480 and 482 is connected in parallel with each of the lamps 405 and 406 at connections 431 and 432 and 442 and 441 respectively. The impedances 480 and 482 are identical within manufacturing tolerances. Preferably, the lamps 405 and 406 have the same power rating within normal manufacturing tolerances. A mid-point voltage monitoring circuit 490 is connected to a mid-point 491 that is electrically connected at any point between the adjacent pair of lamps 405 and 406

A benefit of fitting the impedances 480 and 482 in the lighting circuit of FIG. 4, is that should the voltage rise across one lamp and fall across the other lamp, a resulting slight imbalance of the voltage across each of the lamps 405 and 406 will tend to be corrected by a current flowing through the impedances. Correction of the imbalance of voltage ensures that the lamps operate at as nearly as possible identical power levels. Failure to correct un-matched power outputs may result in the two lamps emitting different levels of illumination or different colour spectra, and may also result in the premature failure of one of the lamps.

Although only two lamps are shown in FIG. 4, as described with reference to FIG. 1 further lamps and in this embodiment, their associated impedances may be added in series with those shown. In order to obtain the benefits of this embodiment with these further lamps, it is also necessary to add further connections corresponding to connection 491 and further mid-point monitoring circuits corresponding to the mid-point voltage monitoring circuit 490.

In a further embodiment not shown but similar to that shown in FIG. 4, impedances with a variable value of impedance replace the fixed impedances 480 and 482 of FIG. 4. The control is further provided with sensing means to sense lamp operating characteristics to provide further information feedback to the control about the operation of the lamps powered by the control. Such further information preferably includes information about the colour of light emitted by each of the lamps. In the further embodiment, the control is arranged to vary the values of impedances to adjust the balance of the power output of the two lamps to obtain a desired operation of the lamps. Preferably the control is arranged so that the information feedback is used to minimise a difference between the colour of the light emitted from each of the lamps. A benefit of doing this is that a perceivable difference in a colour of the light output of the two lamps may be minimised. A further benefit of this further embodiment is that a larger tolerance between the actual characteristics of lamps, from different manufacturing batches or different manufacturers, may be accommodated.

Figure 6:
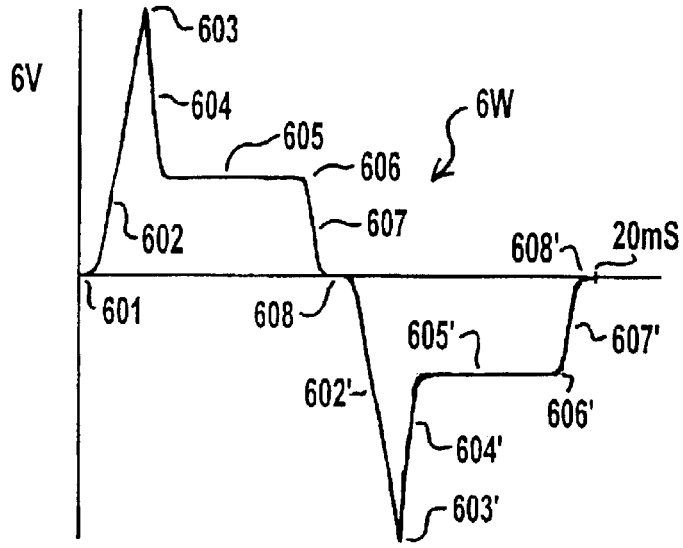
FIG. 6 is a graph of voltage across a lamp powered by a known electromagnetic control.
Figure 7:
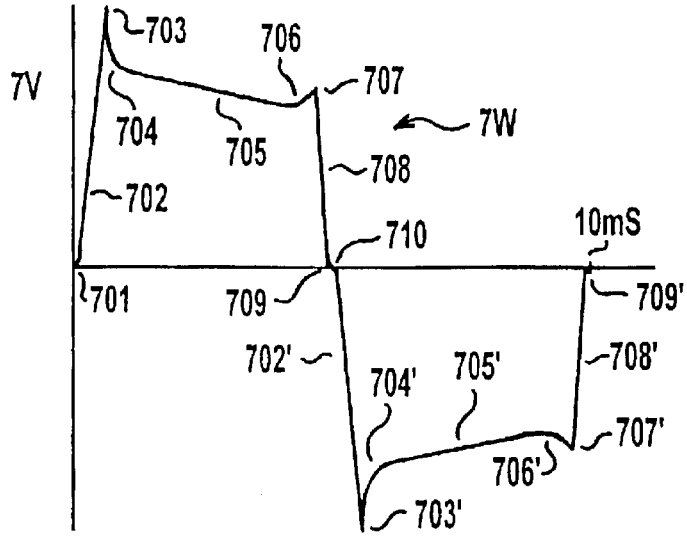
FIG. 7 is a graph of voltage across a lamp powered by a known square wave output electronic control.
Figure 8:
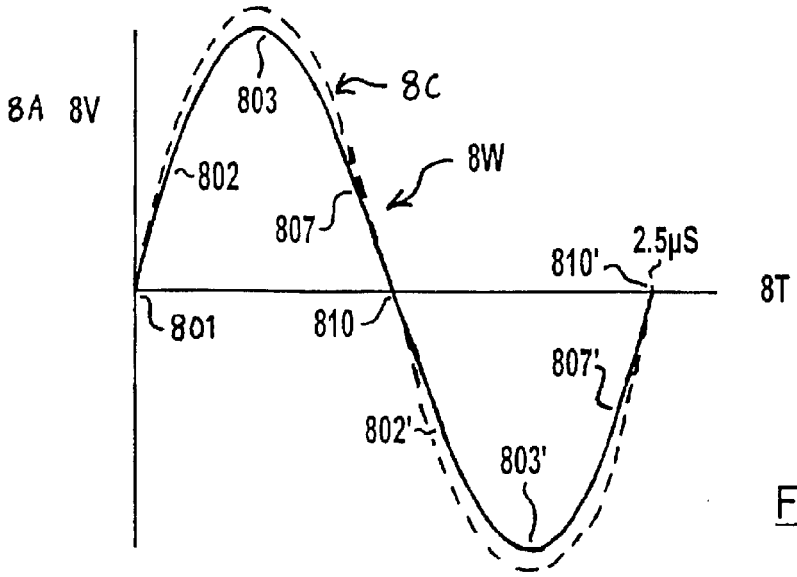
FIG. 8 is a graph of voltage and current across a lamp powered by the electronic control shown in FIG. 9.

FIGS. 6, 7 and 8 show similar graphs of voltage across a lamp when operated in a steady lit state at an intended power input that the lamp was designed to operate at efficiently. When the lamp is in a steady lit state, a light output is produced from an electrical discharge within the lamp that is perceived by the eye to be steady, however with known controls the electrical discharge which comprises an arc, is discontinuous.

FIG. 6 shows a graph of voltage 6V with respect to time 6T of a single cycle of a voltage waveform 6W across a high intensity discharge lamp powered by a known electromagnetic control. The waveform 6W shows a steady state condition when the lamp is lit. A first half cycle of the waveform 6W as shown starts at 601 where the voltage is zero and rises at 602 as the lamp enters a glow mode, to a peak voltage 603, at which point re-ignition of the lamp occurs, the resistance of the lamp decreases rapidly and the voltage falls rapidly at 604 as the lamps starts to conduct again. The voltage reaches a plateau region 605 which is the steady state arc voltage of the lamp, until at 606 the voltage output from the control falls below the arc voltage and the arc is extinguished. The voltage then falls at 607 to zero at 608, where due to the characteristics of the electro-magnetic control, there may be a short period when the voltage is at or near zero, before a second half cycle starts. The second half cycle voltage waveform is the mirror image of, and corresponds directly with, the first half cycle, hence the numbered points corresponding accordingly. A maximum current through the lamp will be reached during the period indicated by the region 605.

A disadvantage of electromagnetic controls is that they operate at the frequency of the supply, and provide an output at the same frequency as the power supply, hence the frequency of the waveform 6W is 50 Hz. Hence in this FIG. 6, the whole cycle time is shown as 20 mS, corresponding to the supply frequency of 50 Hz. Hence, the extinction of the arc between 606 when the voltage output falls below the arc voltage and 603' where re-ignition occurs may give rise to a noticeable flicker of the illumination at a frequency of twice the supply frequency. This may spoil the quality of illumination.

FIG. 7 is a graph of voltage 7V with respect to time 7T across a lamp powered by a known square wave output electronic control. The waveform 7W shows a steady state condition when the lamp is lit. A first half cycle of the wave form 7W as shown starts at 701 and rises at 702 as the lamp enters a glow mode, to a peak voltage 703, at which point re-ignition of the lamp occurs and the voltage falls rapidly at 704 as the lamps starts to conduct again. The voltage reaches a semi-plateau region 705 which is the steady state arc voltage of the lamp, the voltage reduces in this region as the resistance of the arc decreases until at 706 the voltage output from the control approaches the arc voltage and the current through the lamp decreases, causing a slight rise in the resistance of the arc and hence also a rise in the arc voltage at 706, until at 707 the voltage output from the control falls below the arc voltage and the arc is extinguished. The voltage then falls at 708 to zero at 709, where due to intended characteristics of the square wave control, there is a short period 710 when the voltage is at or near zero, before a second half cycle starts. A short period 710 is normally required to ensure that a first switching component in an output stage of the square wave control has sufficient time to switch off completely before a second switching component switches on. The second half cycle voltage waveform is the mirror image of, and corresponds directly with, the first half cycle, hence the numbered points corresponding accordingly.

A disadvantage of square wave controls is that they although they operate at a frequency higher than the frequency of the supply, and in this FIG. 7, the whole cycle time is shown as 10 mS, corresponding to an output frequency of 100 Hz, the shape of the square wave with the short period 710 at or about zero voltage means the arc is extinguished for a significant period. Hence, the extinction of the arc between 707 when the voltage output falls below the arc voltage and 703' where re-ignition occurs may give rise to a noticeable flicker of the illumination at a frequency of twice the output frequency. This may spoil the quality of illumination.

Figure 9:
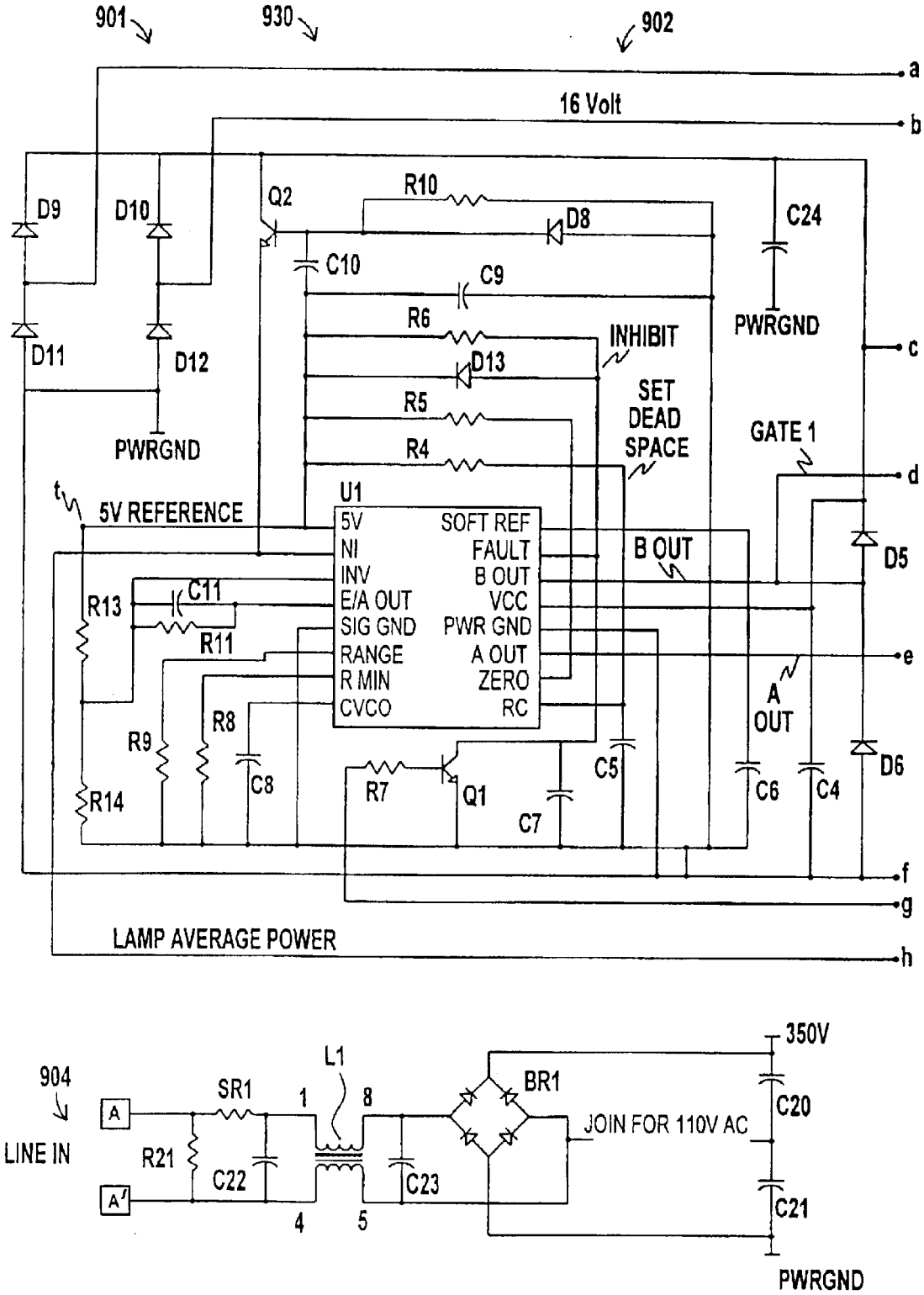
FIG. 9 is a circuit diagram of a lighting system with an electronic control of a fifth embodiment of the invention, which for clarity has been drawn on two pages, the circuit shown at FIG. 9 being connected to the circuit shown at FIG. 9 (continued) at points labelled "a" to "h" inclusive.
Figure 9:
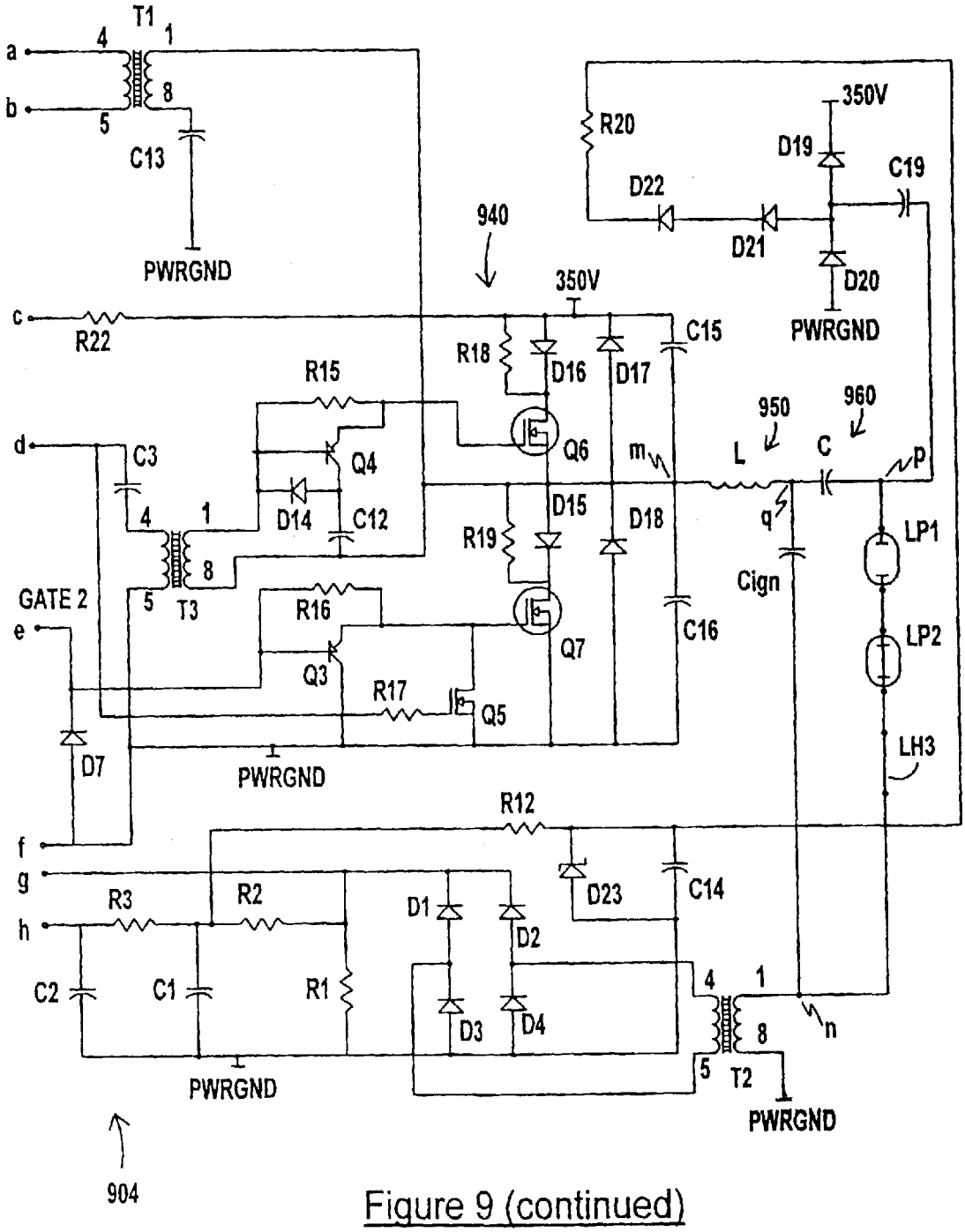

FIG. 8 is a graph of voltage 8V and current 8A with respect to time 8T of a single cycle of a voltage waveform 8W and a corresponding current waveform 8C across a lamp powered by the electronic control shown in FIG. 9. The continuous line waveform 8W shows a steady state condition of voltage when the lamp is lit. A first half cycle of the wave form 8W as shown starts at 801 and rises at 802 to a peak voltage 803 and then falling at 807 to a zero crossing point 810, before a second half cycle starts. At no point in the cycle does the arc extinguish and hence there is no re-ignition of the lamp as in the examples shown in FIGS. 7 and 8. The second half cycle voltage waveform is the mirror image of, and corresponds directly with, the first half cycle, hence the numbered points correspond accordingly. The waveform of FIG. 8 may be seen to be a continuous smooth sinusoidal or closely sinusoidal waveform. The voltage output of this waveform is at a high frequency, in this FIG. 8, the time for a whole cycle is shown as 2.5 micro seconds.

The dashed line waveform 8C in FIG. 8 is a current waveform corresponding to the voltage waveform 8W. In the case of the known electromagnetic ballast of FIG. 6 and the known square wave ballast of FIG. 7 the shapes of the respective current waveforms do not have a close correspondence to the lamp voltage waveforms, however from FIG. 8 it may be seen that there is a close correspondence between the shapes of the current waveform 8C and the voltage waveform 8W.

An advantage of the high frequency of the output is that although there is no conduction of electricity at the instant of the zero point crossing 810, the arc does not have time to extinguish between consecutive half cycles. A further advantage is that as a result of the arc not having time to extinguish is that there is no re-ignition voltage peak, and hence electrical noise and interference emitted by the lamp is reduced as compared with the same lamp operating with the waveforms shown in FIGS. 6 and 7.

Since the voltage waveform 8W and the current waveform 8C closely correspond it may be seen that in this embodiment shown in FIG. 9 the lamp exhibits resistive attributes. Many of the benefits obtained in this embodiment arise from these resistive attributes of the lamp.

Note that the timebases 6T, 7T and 8T are not the same and likewise the voltages 6V, 7V and 8V are not the same, although for a particular lamp operated at the same intended power output in each case will have the same power input into the lamp in each case, hence the integral of the product of the voltage waveforms across the lamp as shown with the respective current waveforms (not shown in FIGS. 6 and 7) through the lamp, will in each case be the same. Since the controls differ in their efficiency in converting the power supply to the controlled power output to the lamp, the power input into each control will differ. The control shown in FIG. 9, with the waveform shown in FIG. 8 has been found to be more efficient than known controls. In practice an efficiency of 94.5% has been found to be obtainable, with only 5.5% of input power going to waste as heat in the control.

From FIG. 9, a lighting system 901 according to a fifth embodiment of the invention with a control 902 and lamps LP1 and LP2 connected in series may be seen. The control 902 comprises a ballast 930 and an ignitor 960, the ignitor having an ignition capacitor Cign in a parallel current path with the lamps. The ignitor 960 comprises an inductor L, and the capacitors C and CIGN. The ballast 930 comprises an integrated circuit U1 and the associated electronic components together with an alternating current power regulator 940 comprising switching elements Q6 and Q7 and waveshaping components 950 which principally comprise inductor L and capacitor C.

Further lamps may be inserted at LH3 connected in series with LP1 and LP2, in which case a power rating of each lamp should be such that the total power rating of the lamps is substantially the same as the combined power rating of the two lamps in the two lamp embodiment. Preferably the lamps are all of the same power rating.

To improve clarity, FIG. 9 has been drawn on two pages, and it may be seen that the two portions of the circuit are connected at the points "a" through to "h".

TABLE 1

Component Values and References for FIGS. 9, 9A, 9B, 9C and 9D

| Symbol | Value/ Reference | Symbol | Value/Reference |
|---|---|---|---|
| D1 | BAS216 | Q1 | BC849 |
| D2 | BAS216 | Q2 | BC849 |
| D3 | BAS216 | Q3 | FMMT720 |
| D4 | BAS216 | Q4 | FMMT720 |
| D5 | RB160L-40 | Q5 | IRML2803 |
| D6 | RB160L-40 | Q6 | IRF840 |
| D7 | RB160L-40 | Q7 | IRF840 |
| D8 | BAS216 | Q8 | BC849 |
| D9 | RB160L-40 | | |
| D10 | RB160L-40 | | |
| D11 | RB160L-40 | | |
| D12 | RB160L-40 | U1 | Unitrode UC3861N |
| D13 | BAS216 | U2A | LM339 |

TABLE 1-continued

Component Values and References for FIGS. 9, 9A, 9B, 9C and 9D

| Symbol | Value/ Reference | Symbol | Value/Reference |
|---|---|---|---|
| D14 | BAS216 | U2B | LM339 |
| D15 | UF5404 | U2C | LM339 |
| D16 | UF5404 | U2D | LM339 |
| D17 | UF5408 | | |
| D18 | UF5408 | T1 | 10:1 Auxiliary Power Transformer |
| D19 | UF4006 | | |
| D20 | UF4006 | T2 | 36:1 Current Transformer |
| D21 | BAS216 | | |
| D22 | BAS216 | T3 | 7:11 Gate Drive Transformer |
| D23 | 15V ZENER | | |
| D24 | IN4148 | TLP1 | 10:1 Lamp Volt Transformer |
| D25 | IN4148 | | |
| D26 | IN4148 | TLP2 | 10:1 Lamp Volt Transformer |
| D27 | IN4148 | | |
| D28 | IN4001 | TLP3 | 10:1 Lamp Volt Transformer |
| D29 | IN4001 | | |
| D30 | Red LED HLMP0300 | | |
| BR1 | 4A 600 V BRIDGE RECTIFIER | L | 76 MICRO-HENRY OUTPUT INDUCTOR |
| | | L1 | 20 MILLI-HENRY COMMON MODE INDUCTOR |
| R1 | 10 kΩ | | |
| R2 | 10 kΩ | | |
| R3 | 10 kΩ | C1 | 10 nF |
| R4 | 18 kΩ | C2 | 10 nF |
| R5 | 100 kΩ | C3 | 100 nF |
| R6 | 100 kΩ | C4 | 100 nF |
| R7 | 3.9 kΩ | C5 | 12 pF |
| R8 | 22 kΩ | C6 | 100 nF |
| R9 | 22 kΩ | C7 | 10 nF |
| R10 | 1 MΩ | C8 | 220 pF |
| R11 | 1 MΩ | C9 | 100 nF |
| R12 | 18 kΩ | C10 | 100 nF |
| R13 | 15 kΩ | C11 | 100 nF |
| R14 | 10 kΩ | C12 | 100 nF |
| R15 | 15 Ω | C13 | 100 nF |
| R16 | 15 Ω | C14 | 3.3 μF |
| R17 | 47 Ω | C15 | 470 pF/1 kV |
| R18 | 47 Ω | C16 | 470 pF/1 kV |
| R19 | 47 Ω | C19 | 220 pF |
| R20 | 827 kΩ | C20 | 220 μF/200 V |
| R21 | 1 MΩ | C21 | 220 μF/200 V |
| R22 | 180 kΩ | C22 | 220 nF/250 VAC |
| R23 | 2.2 kΩ | C23 | 220 nF/250 VAC |
| R24 | 1 kΩ | C24 | 470 μF/25 V |
| R25 | 10 kΩ | C25 | 100 nF |
| R26 | 1 kΩ | C26 | 100 nF |
| R27 | 10 kΩ | C27 | 100 nF |
| R28 | 1 kΩ | C28 | 100 nF |
| R29 | 10 kΩ | | |
| R30 | 4.7 Ω | SWL1 | 15 Volt DC Coil Relay with Normally Closed Contacts (SW1) |
| R31 | 220 Ω | | |
| R32 | 1 kΩ | | |
| R33 | 10 kΩ | | |
| LP1 | HID 35W | LC1 | 3 nF/6 kV |
| LP2 | HID 35W | LC2 | 3 nF/6 kV |
| LP1" | HID 23W | LC1" | 4.5 nF/6 kv |
| LP2" | HID 23W | LC2" | 4.5 nF/6 kV |
| LP3" | HID 23W | LC3" | 4.5 nF/6 kV |
| SCR1 | C106 | C | 11 nF/1 kV |
| SR1 | 20 Ω NTC | CIGN | 1.5 nF/6 kV |

All resistors 1%

All capacitors 5% voltage rating 25 Vdc rating except as stated

FIG. 9 shows a lighting system 901 comprising a control 902 having a power supply input 904 at A and A', which may be either 230V ac or 110V ac (volts alternating current).

Components SR1, C22, L1, & C23 form a filter network that prevents high frequency interference currents generated by the circuit travelling back into the power line. BR1 is a full wave bridge rectifier and C20 and C21 are energy storing smoothing components.

Rectified and smoothed line power is thus available at a voltage typically of 350 volts dc between the point marked 350V and the ground marked PWRGND (FIGS. 9, 9A, 9B, 9C and 9D). This is the primary source of power for the embodiment to be described and will, for simplicity, be referred to as the 350-volt rail.

This method of obtaining direct current from the power line is known to draw undesirable harmonic currents from the power line. The circuit stages involved namely BR1, a full wave bridge rectifier, and C20 and C22 the energy storing smoothing components may be replaced by an "Active Power Factor Correction" circuit in order to overcome the above mentioned disadvantage. Such Active Power Factor Correction circuits are well known and documented in the art and may be employed without detriment to the function of the invention. One property of such active power factor correction circuits is that the output voltage is regulated independent of the line voltage and may be chosen at any convenient value above the peak line voltage, for example 420V dc is a commonly employed value. A benefit of such an increase in the supply voltage to the control circuit is improved lamp ignition, particularly where a plurality of lamps are to be operated.

The 350 volt dc rail is connected and provides power to the alternating current power regulator 940 comprising a zero voltage switching half bridge inverter circuit comprising Q6, Q7, D15, D16, D17, D18, C15 & C16. This inverter circuit supplies high frequency ac power to the lamps.

The operation of the half bridge inverter circuit will now be described with reference to FIG. 9.

Transformer T3 in the circuit diagram performs the level shifting required to operate the gate of the high side transistor Q6 which is a power switching element. Components Q4, R15, D14 and C12 enhance the gate discharge current available to Q6, whilst Q3, R16, R17 & Q5 enhance the gate discharge current available to Q7.

The driving waveforms thus made available to the power switching elements Q6 & Q7 are arranged so as to be in anti-phase thus Q6 is driven on whilst Q7 is biased off and vice-versa. Moreover, the drive waveform provides for a dead space i.e. a small period of time between the commutation of the conduction period of one transistor and the onset of conduction of the other transistor.

Figure 14:
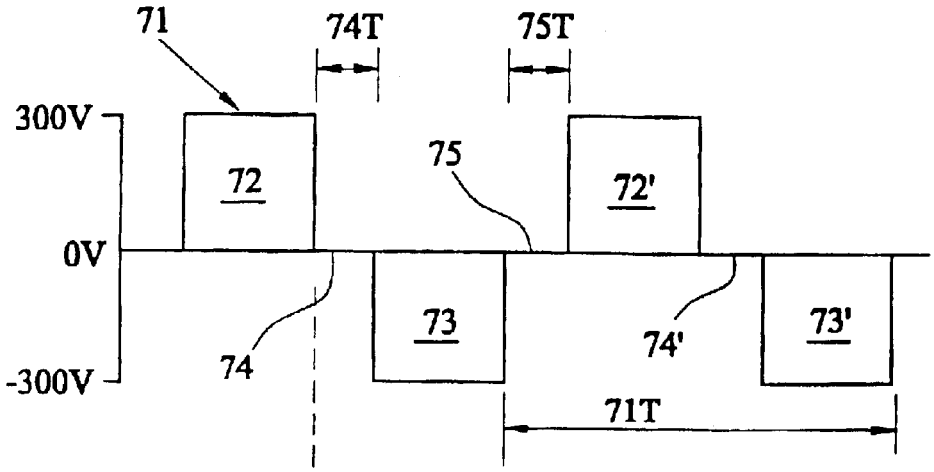
FIG. 14 is a graph of a driving waveform for the output transistors for the embodiment shown in FIG. 9.

From FIG. 14, a graph of such a driving waveform for the output transistors, the power switching elements Q6 and Q7, for the embodiment shown in FIG. 9 may be seen with the voltage on the vertical axis and time on the horizontal axis. The driving waveform 71 comprises a square wave positive pulse 72 and a negative pulse 73, separated by a zero voltage dead space 74, the negative pulse followed by a second dead space 75. This is then repeated at a time interval of 71T such that the frequency of the waveform is greater than 400 kHz. The dead spaces have a time interval of 74T and 75T respectively, and preferably this time interval is such that the output transistors have sufficient time to cease conducting, and also that the energy stored in the reactance of the output circuit is sufficient to reverse the potential of the output side of the output transistors so that they do not have to switch any voltage.

In this embodiment of FIG. 9, 300 ns has been found to be an acceptable time interval for the dead spaces 74T and 75T with a whole cycle time interval 71T of 2 $\mu$s at 500 kHz.

Figure 15:
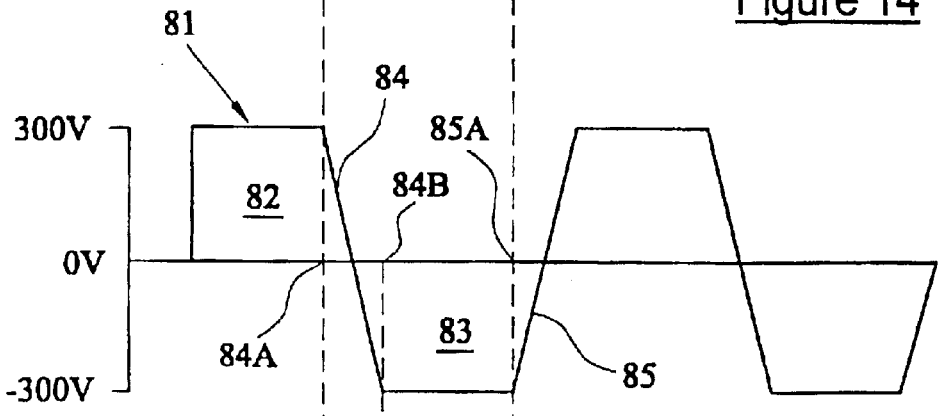
FIG. 15 is a graph showing an output waveform of the power output to the lamp at a preferred operating condition.

FIG. 15 shows an output waveform 81 of the power output to the lamps LP1 and LP2 of FIG. 9 at a preferred operating condition when driven by the driving waveform of FIG. 14. The preferred operating condition is such that when the first output transistor ceases to be driven at 84A, the stored energy in the output reactance L and C of FIG. 9 is sufficient to produce the voltage change shown by line 84, such that at time 84B the voltage has reversed completely and the second transistor begins to conduct to maintain the negative pulse until time 85A when the reactance again drives the voltage up line 85.

Figure 16:
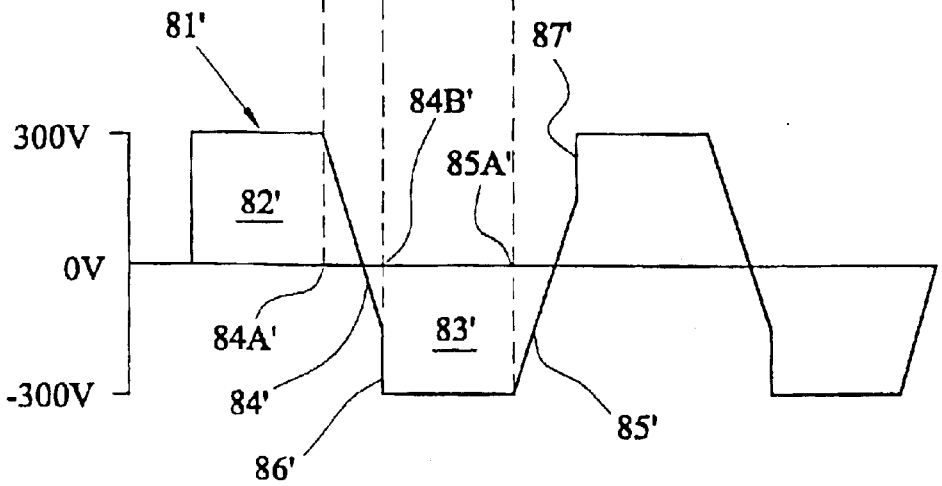
FIG. 16 shows an output waveform similar to FIG. 8, but at a non-preferred operating condition and resulting from the driving waveform of FIG. 7.

FIG. 16 shows an output waveform 81' similar to FIG. 15, but at a non-preferred operating condition and resulting from the driving waveform of FIG. 14. The non-preferred operating condition is such that when the first output transistor ceases to be driven at 84A', the stored energy in the output reactance L and C of FIG. 9 is insufficient to produce the preferred voltage change, and can only produce the voltage change shown by line 84', such that at time 84B' the voltage has not reversed completely and when the second transistor begins to conduct to maintain the negative pulse it has to increase the output potential by a step change 86', where it maintains the voltage until time 85A' when the reactance again drives the voltage up line 85'. Again this is insufficient to completely reverse the voltage and the first transistor has to increase the output voltage by a step change 87'. These step changes in voltage are undesirable.

Figure 17:
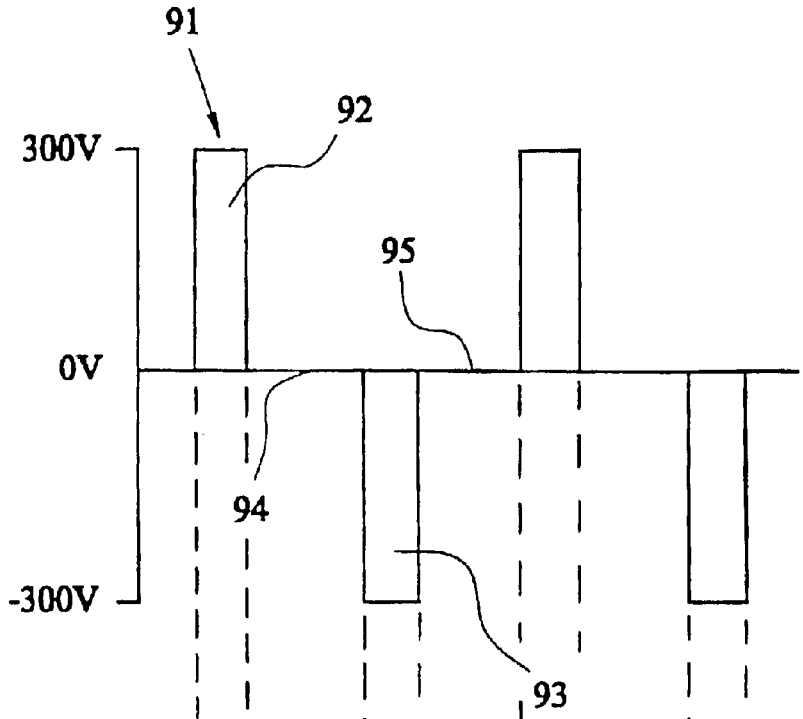
FIG. 17 is a graph of a driving waveform for the output transistors for the embodiment shown in FIG. 9 at a higher frequency.
Figure 18:
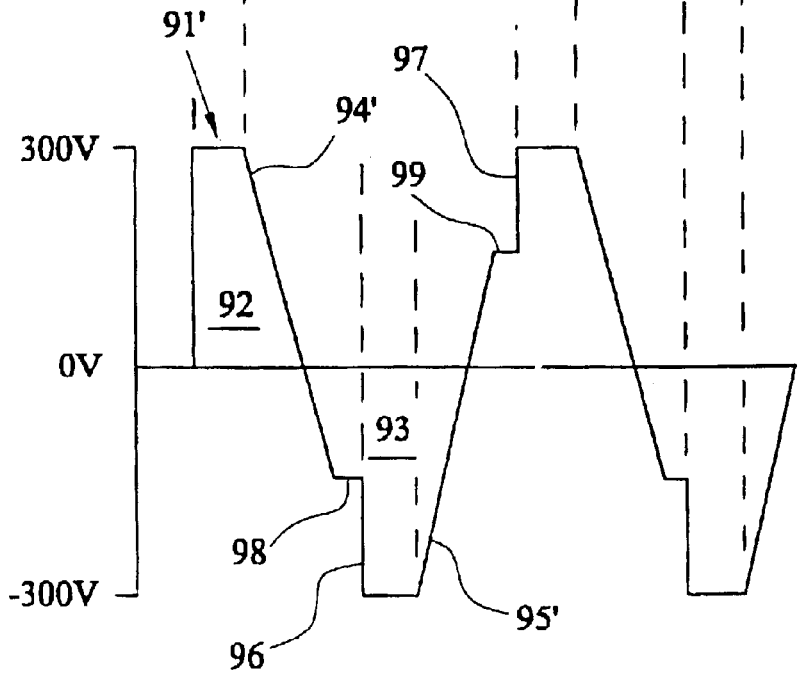
FIG. 18 is a graph of an output waveform resulting from the driving waveform of FIG. 17.

FIG. 17 is a graph of a driving waveform 91 for the output transistors for the embodiment shown in FIG. 9 at a higher frequency and show how the dead space time intervals 94 and 95 must remain the same at 300 ns to allow the transistors to switch completely. However, from FIG. 18 which is a graph of an output waveform 91' resulting from the driving waveform 91 of FIG. 17, it maybe seen that due to the increased frequency there is no longer sufficient energy in the output pulses 92 and 93 to enable the output reactance to store sufficient energy to completely reverse the voltage. Hence, the voltage change 94' reaches a steady state voltage at 98 before the output transistor is driven, and hence the output transistor has to increase the output voltage by step change 96. Similarly, in the second half of the cycle, the voltage change 95' reaches a steady state voltage at 99 before the output transistor is driven, and hence the output transistor has to increase the output voltage by step change 97.

This dead space serves two functions, the first is to ensure that Q6 & Q7 cannot conduct simultaneously and the second is to provide a time interval for the resonant transition of current from one transistor to the other.

This resonant transition of current may provide considerable benefit to the electrical efficiency of the circuit, since by this means the considerable switching losses that would otherwise occur in such a circuit are avoided altogether.

The operation of this feature will now be described by comparison with a circuit that does not support resonant transition switching.

In a conventional inverter, the power switching elements are not equipped with parallel capacitors C15 & C16. When one or other device commutates current, such current continues to flow in the device for a period of time known as the "fall time". During such fall time the device supports simultaneously a high current and voltage which leads to high power dissipation during the commutation event. When the commutation events occur at high frequencies, such as is the case in the present invention, considerable power is lost. This loss is commonly referred to as switching loss.

The introduction of C15 & C16 into the circuit can, under certain operating conditions, completely eliminate this switching loss. The important conditions are:

1. that a dead space is provided by the driving circuit waveforms; and 2. that the load driven by the inverter is inductive in nature and is of a certain minimum current.

As has already been stated a simple constraint in the operating frequency range will ensure that the operating frequency lies above the resonant frequency of L and C so that the inverter always drives an inductive load during lamp operation. The above conditions are therefore met in this embodiment of the present invention.

In the resonant transition variant of the half bridge inverter, capacitors C15 & C16 provide an alternative pathway for the inductive current normally commutated by the power switching elements. When for example the driving waveform for the gate of Q7 goes to the low state Q7 ceases to conduct. Current continues to flow through the inductor L however, so that the current, which was flowing in Q7, now commutates without loss into the capacitor C16. The direction of current flow is such as to charge C16 resonantly towards the upper 350-volt supply rail.

Sufficient time must be allowed in the dead space for this charging process to occur. The components C5 & R4 set the dead space period by way of a monostable internal to the control IC U1.

The energy required to charge C16 in this manner is derived from energy stored in inductor L. However, inductor L stores more energy than is required to charge C16 to a voltage equal to the upper supply rail.

This additional energy is returned to the supply rail via D17. D17 is in anti-parallel to Q6 and serves in conjunction with D16 to prevent the flow of current in the "body Diode" of Q6.

Exactly the same process occurs when Q6 commutates current into C15 during the opposite half cycle of inverter operation.

The body diodes of power mosfet transistors have long reverse recovery times that lead to poor high frequency performance and device failure if the inverter circuit feeds capacitive loads. If the load is capacitive, for any reason, then the body diode of one device can be conducting when the opposite device is turned on. This event causes very high currents to flow in both devices for the duration of the body diode reverse recovery period.

Although operation of the inverter is always into an inductive load, if the lamp is running, capacitive loads can be present during lamp ignition so that D15, D16, D17 & D18 are provided to eliminate the possibility of catastrophic transistor failures during lamp ignition.

Driving waveforms for the two inverter transistors Q6 & Q7 are preferably derived from a control integrated circuit U1 available on the market, and manufactured by Unitrode Inc. of USA Type UC3861. The designations on the integrated circuit U1 shown in FIG. 9 correspond to the manufacturers designations.

This integrated circuit U1 performs a number of functions useful to the invention, although these functions may equally well be obtained from an alternative suitable circuit arrangement. The integrated circuit may be made sensitive to the prevailing lamp and supply conditions and can therefore be used to control the half bridge inverter circuit so as to start lamps, limit the range of operating frequencies, and to regulate the power of running lamps. The manner in which one embodiment of the invention utilises the control integrated circuit will now be described with reference to FIG. 9.

Operating power for the control IC U1, is derived from two sources, one source is utilised during circuit start up and relies upon a particular characteristic of the control IC. The other source is used to supply power to the IC in steady state operation with a running lamp. In this way, a useful mode of lamp ignition is ultimately obtained.

The IC characteristic mentioned above is known as Under Voltage Lock Out (UVLO) which prevents operation of the IC when the supply voltage to the IC is too low for proper operation. When the IC is in the under voltage condition it is said to be below the UVLO start threshold. In this mode, the IC draws a very low current from its supply.

Accordingly, a high value of resistance from the 350-volt rail (R22 in FIG. 9) will supply sufficient current to charge C24 to the upper UVLO threshold. (C24 is connected across the supply pins of the control IC). Once the upper UVLO threshold of the control IC has been reached the IC will become operational and draw a high current from the capacitor C24.

This capacitor is sized such that sufficient energy is stored in it to allow operation of the IC for some 40 ms. During this period of operation the outputs of the IC will become active and drive the gates of the inverter transistors Q6 & Q7. Once the inverter has become active, a small auxiliary transformer T1 has its primary energised via a coupling capacitor C13. This transformer T1 has a 10:1 reduction ratio and its secondary is full wave rectified by D9, D10, D11, & D12. The rectified output is applied across C24 so as to maintain a continuous supply of power to the control IC.

At the moment of power up the 5-volt reference pin of the IC becomes active and rapidly transitions between 0 and 5 v. This transition is capacitively coupled to the base of emitter follower Q2 via C10 so that the emitter of Q2 moves to an initial voltage of approximately 4.3 volts. As C10 charges the emitter, the voltage of Q2 falls towards 0 volts. The time constant of this circuit is set by R10. D8 ensures that C10 is immediately discharged if the 5 volt output of the control IC falls to zero. D8 thus provides a means of resetting C10.

The action of this part of the circuit is such as to force the voltage-controlled oscillator (VCO) internal to the IC to run at its maximum programmed frequency on power up. As C10 charges and the voltage on the emitter of Q2 falls the VCO frequency falls towards the minimum programmed frequency. C8, R8 & R9 conveniently program the maximum and minimum frequencies of the VCO.

The output of the VCO is internally divided by two and used as a clock for the IC outputs, so the overall effect of this sub-circuit is to cause the inverter output to sweep between a maximum and a minimum frequency at power up. The rate of this sweep is defined ultimately by the time constant of C10 and R10.

During this power-up frequency sweep at a particular frequency PF a series resonance of L and Cign will be excited, producing a burst of high voltage at the particular frequency PF across the lamp terminals, thereby breaking the lamp down into the glow mode of operation. The output frequency of the inverter will continue to fall rapidly to the minimum programmed frequency. This will minimise the reactance in series with the lamps LP1 and LP2 thereby maximising lamp current, so as to ensure a rapid glow to arc transition. This sequence may be seen from FIG. 13 as described below.

Should the lamps fail to light, a time-out circuit comprising C7 & R6 will cause the control IC to shut down its outputs thus inhibiting the inverter activity. The time constant of C7 & R6 is preferably made small so as to limit operation of the inverter to a short period of time in this "ignition" mode. Preferably, the short period of time is less than 10 seconds, and more preferably less than 500 milliseconds, and still more preferably to less than 100 ms.

This short period of time minimises the exposure of the inverter transistors to the high dissipation conditions that exist if the inverter is allowed to run continuously without a lamp load. Under these conditions, the inverter would be driving a capacitive load with consequent high switching losses.

As soon as the action of the time out circuit has inhibited inverter operation, the auxiliary transformer T1 is deprived of power, so that this source of supply power to the control IC is removed. The current flowing through R22 alone cannot sustain operation of the IC, so that capacitor C24 becomes discharged. Once the voltage on C24 falls below the lower UVLO threshold the IC will revert to its low power mode and the charge cycle of C24 begins once more, leading to another power up ignition sequence. This process will continue until the lamp eventually lights, or mains power is removed from the control.

This process provides an automatic means of lighting lamps that have become too hot to start as a result of a previous period of normal operation, without wasting power in the control. Hot lamps have increased lamp fill pressures, which can elevate the voltages required for lamp ignition to undesirably high levels.

If the attempt to light the lamps was successful, lamp current flowing through the primary of the lamp current sense transformer T2 causes a scalar current to flow in the secondary of T2. This secondary current is full wave rectified by D1, D2, D3 & D4. This rectified current produces a voltage drop across R1, the current sense resistor. This voltage is proportional, therefore, to the lamp current. This voltage is applied to the base of Q1 via R7 so that if the lamps have started the time out circuit of C7 & R6 is defeated by the action of Q1 and continuous operation of the circuit is allowed.

Once continuous operation has become established, the function of the control IC becomes that of regulating lamp current and power.

In order to regulate lamp power both lamp current and lamp voltage must be sensed. Lamp current sensing is by way of the current sense transformer T2 and the above mentioned current sense resistor.

Averaging components R2, C1, R3 and C2 present a signal (I lamp average) to the control IC which is proportional to the lamp current. An operational amplifier internal to the control IC compares this signal with a set point established by R13 & R14. In this way the lamp current signal causes the frequency of the VCO to be increased or decreased in order to maintain the set point current. Components C11 & R11 are used to tailor the frequency response of the operational amplifier so as to maintain loop stability under all operating conditions.

Holding lamp current constant in this way would take no account of the lamp power variations caused by lamp voltage changes. Lamp power would be proportional to lamp voltage. Accordingly the lamp voltage is sensed and averaged by components C19, D21, D22, R20, C14, & D23. Components D19 & D20 limit the lamp voltages sensed, so as to prevent false operation during lamp ignition.

The signal thus derived is proportional to lamp voltage and is resistively summed with the average lamp current signal presented to the control IC via R12. In this way the actual lamp current set point is reduced according to increased lamp voltage, so as to obtain constant lamp power operation over the anticipated range of lamp voltages. This method is well known in the art and is referred to as "linear Interpolation".

Over the normal range of combined lamp voltages across LP1 and LP2, lamp power will be held substantially constant by the use of this control method. If however the combined lamp voltage falls outside of the normal range, lamp power will deviate significantly from the nominal value. In a preferred embodiment of the invention, the lamp voltage and current signals are summed in such a way as to reduce lamp power if the lamp voltage falls outside of the normal operating range.

It is a characteristic of high intensity discharge lamps that, at end of lamp life, lamp voltage will deviate considerably from normal values. If the electrodes of the lamp have become eroded, for example as a result of extended operation, the lamp voltage will be increased as a function of the increased length of the arc discharge within the lamp. If the arc tube has developed a leak, or if lamp fill has been lost by some other mechanism, the lamp voltage will fall as a function of the reduced fill pressure within the lamp.

One disadvantage of high intensity discharge lamps is the risk of explosive lamp failure arising as a consequence of their high operating temperatures and pressures. The risk of this type of failure increases greatly if the lamp is operated beyond its rated life.

The risks of the lamp failing explosively in this way at the end of its rated lifetime are considerably diminished if the power supplied to the lamp is reduced. The action of the control method, which automatically reduces lamp power if lamp voltage falls outside of the normal range, is such as to reduce the risk of explosive lamp failure at end of lamp life.

Figure 9A:
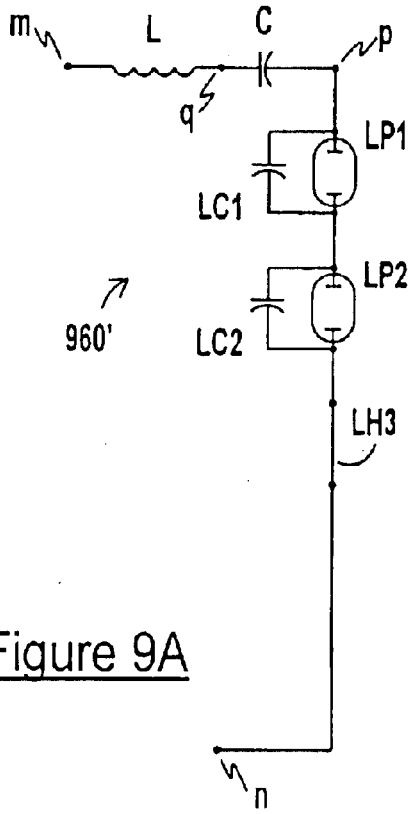
FIG. 9A is a circuit diagram of a sixth embodiment based on the fifth embodiment of FIG. 9.

In a sixth embodiment shown in FIG. 9A, part of another circuit arrangement is shown. Similarly marked components correspond directly with those components shown and described with reference to FIG. 9.

FIG. 9 shows the ignition capacitor Cign connected in parallel with the lamps LP1 and LP2, such that when the ignition resonance occurs the ignition voltage is applied across both lamps together. The lamps will light simultaneously, since conduction cannot occur in one lamp, without conduction also occurring in the other.

FIGS. 9A, 9B, 9C and 9D show further embodiments based on the fifth embodiment of FIG. 9, and show a portion of the circuit between points labelled "m", "q", "p" and "n" on the figures which replaces the corresponding portion of the circuit of FIG. 9. Where necessary they also make additional connections to the circuit shown in FIG. 9 at points "b" which is a 16V line, and "g".

FIG. 9A shows a sixth embodiment based on the fifth embodiment of FIG. 9, with the same lamps LP1 and LP2, but with the ignition capacitance comprised of two lamp capacitors LC1 and LC2 across each lamp respectively. The combined value of LC1 and LC2 is arranged to be equivalent to the value of Cign of FIG. 9 when the lamps are not lit. In FIG. 9A, igniter 960' comprises inductor L, lamp capacitors LC1 and LC2, and capacitor C. Hence, in operation before either lamp is lit, when ignition resonance occurs the ignition voltage is applied across both lamps together at the same resonant frequency as in FIG. 9. Variations between lamps and associated components and connections is likely to cause one lamp to light before the other, at which point the lamp that becomes lit will reduce in resistance and effectively short circuit its associated lamp capacitor removing it from the resonant circuit. The current through the lit lamp will be conducted by the lamp capacitor across the remaining unlit lamp. The value of capacitance in the resonant circuit is reduced to the value of the single lamp capacitor associated with the unlit lamp, and hence the resonant circuit now has a new lower resonant frequency. Hence as the frequency of the power output continues to fall a second resonant voltage peak is reached, at which point almost the whole resonant voltage is applied across the lamp that remains unlit. Hence, a benefit of the circuit shown in FIG. 9A is that reliable starting of two or more lamps is ensured.

Figure 9B:
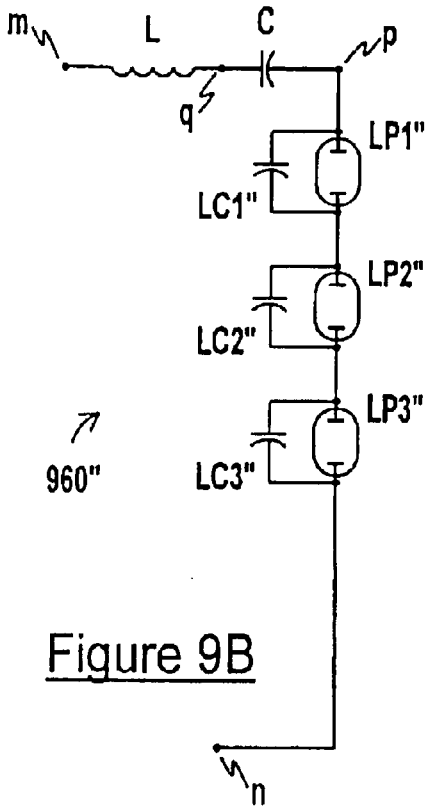
FIG. 9B is a circuit diagram of a seventh embodiment based on the fifth embodiment of FIG. 9.

As in the case of FIG. 9 further lamps LP3" may be added to the arrangement shown in FIG. 9A together with their associated lamp capacitors LC3" to obtain the benefits described above. This is shown in FIG. 9B, where ignitor 960" comprises inductor L, lamp capacitors LC1", LC2" and LC3", and capacitor C. A power rating of each of the lamps LP1", LP2" and LP3" of FIG. 9B are preferably each two thirds of a power rating of each of the lamps LP1 and LP2' of the two lamp embodiments of FIGS. 9 and 9A.

In a particular embodiment of the invention, the control and the first lamp LP1 are mounted in close proximity to each other in a luminaire, and the second lamp LP2 is mounted remotely. The remote location of the second lamp introduces additional capacitance arising from a capacitance of connections between the lamp and the control. In the case of the circuit arrangement shown in FIG. 9 the stray capacitance will produce an uneven distribution of ignition voltage between the lamps which may preclude proper ignition of the lamps. However, in the case of the circuit arrangement shown in FIG. 9A is that each of the lamp capacitors will ensure that a more even distribution of ignition voltage across each of the lamps. Preferably, each of the lamp capacitors is mounted in close proximity to its associated lamp.

Figure 5:
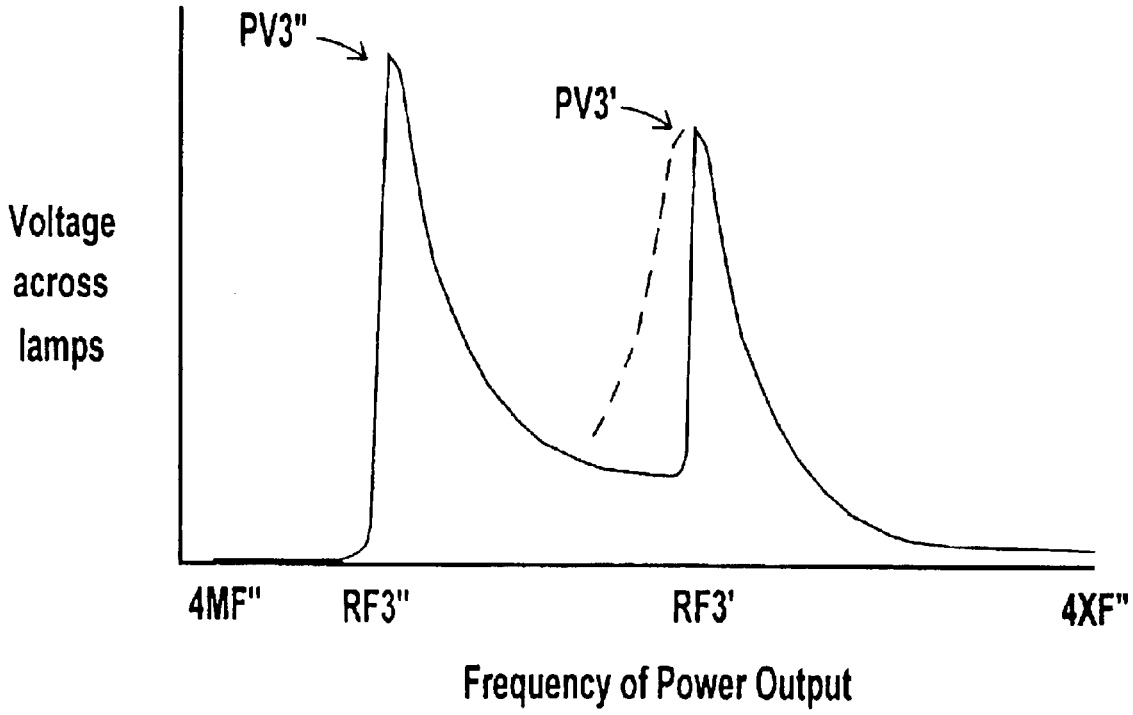
FIG. 5 is a graph of voltage across the lamps against frequency when the lamps of the arrangement shown in FIG. 9A are being started.
Figure 10:
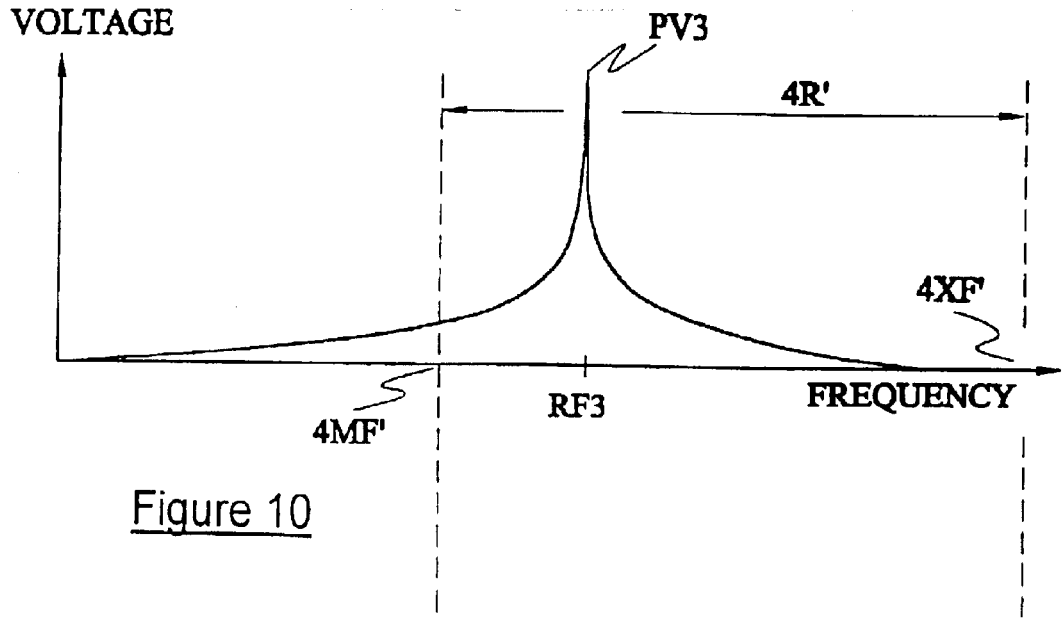
FIG. 10 is a graph showing a relationship between an open circuit lamp start voltage and frequency of an electrical supply from an alternating current output regulator across a lamp of the fifth embodiment shown in FIG. 9.

FIG. 5 shows a comparable graph of voltage against frequency for the arrangement shown in FIG. 9A to that shown in FIG. 10 that relates to the arrangement of FIG. 9. As in FIG. 10, the voltage available from the ignition circuit has been shown, but it will be noted that in FIG. 5 when a lamp starts this will affect the actual instantaneous voltages in the circuit. From FIG. 5 it may be seen that as the frequency falls from a high initial frequency 4 XF" a first resonant peak PV3' is reached at RF3' where at a first lamp ignition voltage the first lamp will start and begin to conduct. Hence, the resonance of the circuit will cease as the lamp capacitor associated with the lamp that has started has been removed from the circuit. As the frequency of the voltage output continues to fall a second resonant peak PV3" at a second resonant frequency RF3" occurs where substantially the whole of the second resonant peak voltage is applied across the unlit lamp. Thus, reliable ignition is ensured.

In FIG. 5, the frequency continues to fall to a minimum frequency 4 MF", before rising again as described with reference to FIG. 13.

Figure 9C:
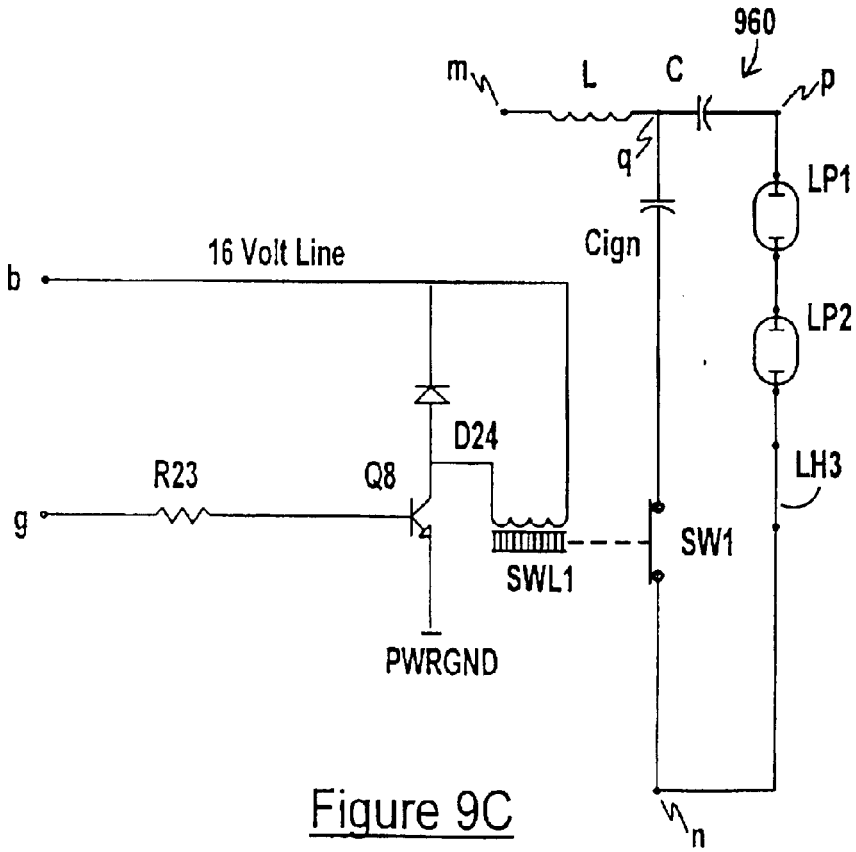
FIG. 9C is a circuit diagram of a eighth embodiment based on the fifth embodiment of FIG. 9.

FIG. 9C shows a seventh embodiment based on the fifth embodiment of FIG. 9, with the same lamps LP1 and LP2, but with a switch SW1 in series with the ignition capacitance Cign. The switch SW1 is preferably a relay comprising normally closed contacts. In operation once the lamp is lit the line g will attain a high voltage as described above causing transistor Q8 to conduct and hence energise a switch relay coil SWL1 opening the normally closed contacts.

The switch SW1 has been described as an electromagnetic relay but could be a semiconductor switch.

The benefits of the seventh embodiment shown in FIG. 9C is that resistive losses arising from the charging and discharging currents associated with the ignition capacitance Cign in the course of normal operation of the lamp when lit may be eliminated once the switch SW1 has operated. Particularly, it has been found that these charging and discharging currents otherwise cause undesirable heating of the inductor L.

Figure 9D:
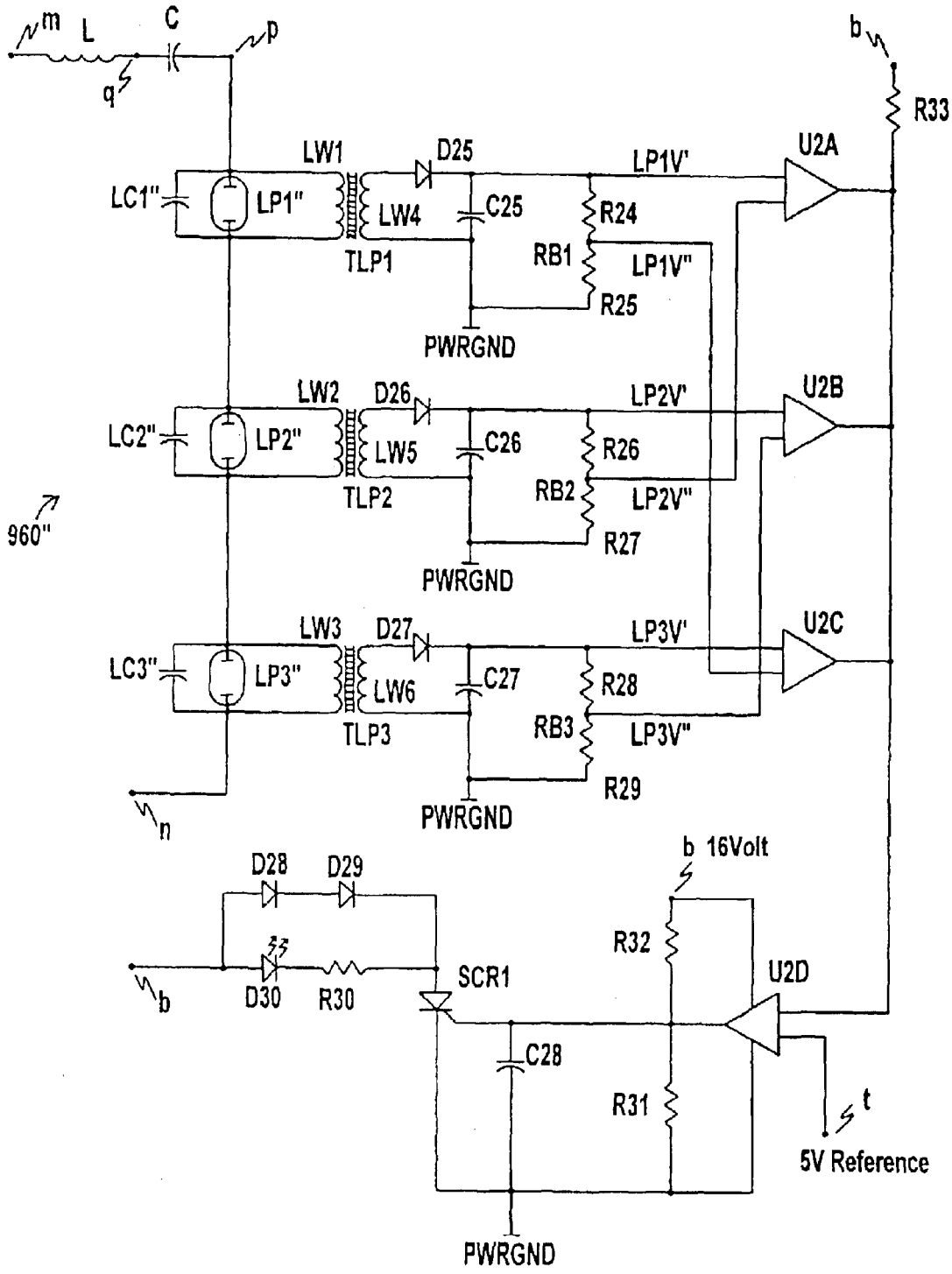
FIG. 9D is a circuit diagram of a ninth embodiment based on the fifth embodiment of FIG. 9.

FIG. 9D shows an eight embodiment of the invention based on the fifth embodiment providing the same benefits as shown in FIG. 4. From FIG. 9D three lamps LP1", LP2" and LP3" are shown connected in series with associated lamp capacitors LC1", LC2" and LC3" connected in parallel with each lamp. Also connected in parallel with each lamp is a high impedance primary winding LW1, LW2 and LW3 respectively arranged to sense the voltage across each lamp. Each primary winding LW1, LW2 and LW3 is arranged to produce a lower voltage output from a secondary winding LW4, LW5 and LW6 respectively. Preferably the primary and secondary windings are coupled by a magnetic core arranged to saturate when the voltage across each lamp rises significantly above a normal arc voltage to minimise the effect of the ignition voltages on sensing components connected to the secondary windings. The outputs from the secondary windings are connected through diodes D25 D26 and D27 to smoothing capacitor C25, C26 and C 27 and resistor bridges RB1, RB2 and RB3 respectively to produce for each lamp a first dc voltage and a second dc voltage. The resistor bridge being arranged so that for each lamp the second dc voltage is lower than the first dc voltage by a voltage difference corresponding to an maximum acceptable out of balance voltage of the lamp when it is operating in a lit state. The first dc voltage for one lamp is compared with the second dc voltage for another lamp such that if a voltage variation of the second voltage of any lamp exceeds the first voltage of another lamp then one or other of the comparators U2A, U2B and U2C will take its output low so that the input to U2D is taken below a reference voltage derived from U1. In this condition the output of U2D will go high and trigger SCR1. When triggered thyristor SCR1 is arranged so as to draw a high current from the 16V supply rail which powers U1 (FIG. 9), bringing the 16V rail below the Under Volt Lock Out UVLO threshold of U1. As a consequence U1 ceases to operate and drive is lost to the power transistors Q6 and Q7 switching the lamps off. This fault condition will remain latched due to the holding current supplied through R22 to SCR1 until the mains supply is removed from the circuit. The anode circuit of SCR1 contains an indicating LED protected from excess current by series resistor R30 and parallel diodes D28 and D29.

In any of the above embodiments shown and described with reference to FIGS. 9, 9A, 9B, 9C, and 9D, the ignition capacitor(s) formed by Cign or the lamp capacitors LC as may be the case, may be arranged so that the resonant frequency of the ignition circuit formed by these capacitors and the inductor L lies within the output frequency range as already described above with reference to the operation of the ignition circuit. However benefits may be obtained by choosing values for Cign or LC as may be the case, such that the resonant frequency lies above the output frequency range and preferably has a resonant frequency three times that of the previously described resonant ignition circuit. Such an arrangement is referred to as a third harmonic ignition system, since the frequency of the ignition voltage derived is three times greater than the exciting voltage frequency. A major benefit of such an arrangement is that an input impedance of the ignition circuit is increased thereby reducing the currents drawn from the supply during the ignition resonance. This reduction of current permits a reduction in the size and cost of the switching components Q6 and Q7. A further benefit of the increased impedance of the ignition circuit is that the impedance of the capacitor is increased, and hence the size of the capacitor is reduced, thereby reducing the charging and discharging currents that would otherwise be present during normal lamp operation in all cases except the embodiment shown in FIG. 9C.

Yet a further benefit of the increased impedance is that the resonant condition may be maintained for a longer period of time without risk of damaging the switching components Q6 and Q7. This assists with the ignition of lamps.

Variations in the line power voltage have no effect on lamp power since the closed-loop feedback, described above with reference to FIG. 9, automatically compensates for such variations by adjusting the frequency of the inverter circuit so as to hold lamp power constant.

The response time of the operational amplifier internal to the control IC U1 and associated external components is such as to allow the circuit to respond to the ripple voltages present on C20 & C21 which will be at twice the power line frequency.

The effect of this ripple voltage on lamp power is also therefore eliminated and any lamp power variations occurring at the second harmonic of the power line frequency will be eliminated. Such lamp power variations can lead to visible lamp flicker, which is undesirable in many applications.

A further benefit arising from the above is that the inverter frequency becomes modulated as a function of the second harmonic of the power line frequency. This frequency modulation spreads the ballast operation over a range of frequencies. This reduces the instantaneous sub-harmonic energies available to excite acoustic resonance in lamps and improves lamp stability. This spread-spectrum operation also reduces radiated and conducted interference from the ballast, reducing the precautions needed to constrain such interference to acceptable levels.

Examples of commercially available high intensity discharge lamps that would be suitable for use in the above embodiments described with reference to FIG. 9 are, in the case of the two lamp embodiments, a 35W Philips MASTERCOLOUR CDM-T (Registered Trademark) or a 35W GE ARCSTREAM (Registered Trademark).

FIG. 10 shows a relationship between an open circuit lamp start voltage versus a frequency of the lamp start voltage. It may be seen that at a resonant frequency RF3 of inductor L and capacitor Cign of FIG. 9 a high peak voltage PV3 is generated. This voltage is arranged to be sufficient to cause the lamps LP1 and LP2 to begin to conduct. The resonant frequency RF3 is within the operating frequency range 4R' between 4MF' and 4XF' which are the same as the frequencies 4MF and 4XF and range 4F described below.

Figure 11:
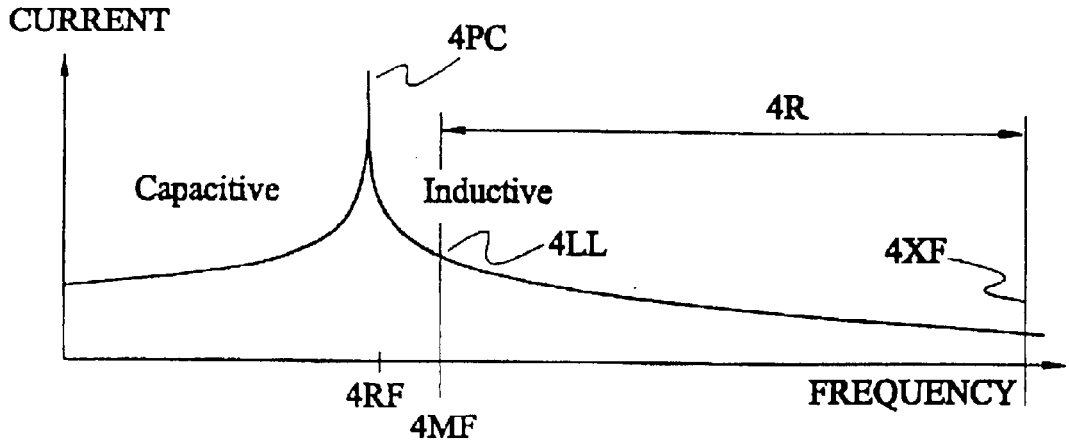
FIG. 11 is a graph showing a relationship between current through a lamp and the frequency of the electrical supply to the lamps of the fifth embodiment shown in FIG. 9.

FIG. 11 is a graph showing a relationship between running current through the lamps LP1 and LP2 and the frequency of the electrical supply from the alternating current power output regulator 940 shown in FIG. 9. It may be seen that at the resonant frequency 4RF of inductor L and capacitor C a high resonant current 4PC is generated. To ensure that the current through the lamp may be controlled, the alternating current power output regulator 940 is arranged to operate over a frequency range 4R above a minimum frequency 4MF which is 400 kHz or above and below a maximum frequency 4XF. Using currently available commercial components the maximum frequency currently available is limited to about 500 kHz, but higher maximum frequencies would provide additional benefits relating to safety and operation described below.

Figure 12:
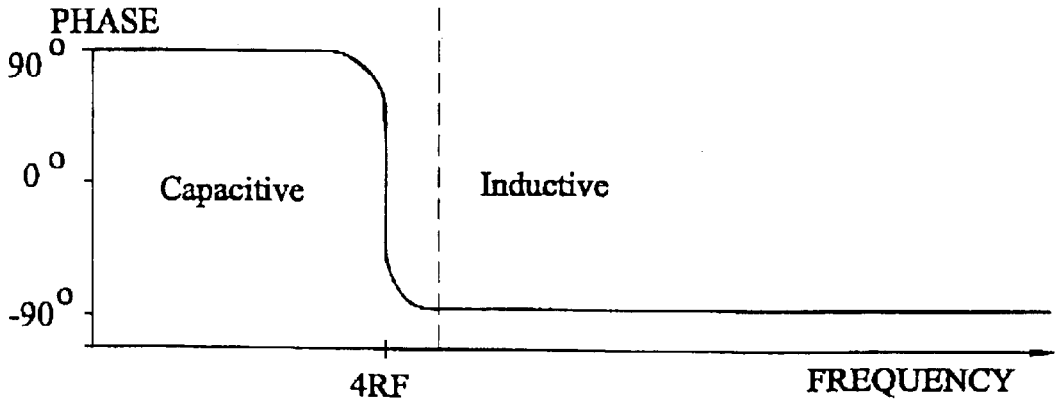
FIG. 12 is a graph showing a phase angle relationship between a running current through the lamps and the frequency of this electrical output from the alternating current power output regulator of the fifth embodiment shown in FIG. 9.

FIG. 12 is a graph showing a phase angle relationship between a running current through the lamps LP1 and LP2 and the frequency of this electrical output from the alternating current power output regulator 940 as shown in FIG. 9. It may be seen from FIG. 12 how the load on the output of the alternating current power output regulator 940 becomes inductive above the resonant frequency of the inductor L and the capacitor C. The operation of the alternating current power output regulator 940 may be made more efficient by operating in the inductive part of this graph.

The value of Cign in FIG. 9 is chosen such that series resonance between L and Cign occurs at some series resonant frequency RF3 (of FIG. 10) within the frequency range 4R' of the alternating current power output regulator 940, but above the series resonant frequency 4RF (of FIG. 11) of L and C.

Prior to ignition of the lamp the lamp will behave substantially as an open circuit so that no load is presented to the network of L, C and Cign.

The frequency of the alternating current power output regulator 940 is arranged to be reduced until its output frequency corresponds to the above-mentioned series resonant frequency RF3 of L and Cign. It is a characteristic of series resonant circuits that they exhibit low impedance at their resonant frequency. Thus a large current is driven, by the alternating current power output regulator, through the series resonant circuit formed by L and Cign. As the lamp is still an open circuit no current passes through it, or the series connected capacitor C.

This large resonant current flows through capacitor Cign, which has finite impedance. As a result of the finite impedance of capacitor Cign and the large current flowing through it, a high voltage PV3 (FIG. 10) is developed across capacitor Cign. Preferably the high voltage PV3 is in a range between 500 volts and 50,000 volts. More preferably for HID lamps the high voltage PV3 would be between 2,000 volts and 5,000 volts. The lamps are connected in parallel with capacitor Cign and as a result of the high voltage present across the lamps, a gas in each of the lamps breaks down and enters a glow mode of operation. The lamps now no longer represent an open circuit and, as a consequence, current begins to flow through the lamps LP1 and LP2. The lamp voltage in this glow mode falls rapidly from the open circuit value (2–5 kV) to a very much lower voltage of some 200–300 volts. Eventually the power being dissipated in each of the lamps causes the lamps to transition from the glow to the arc mode of operation. The low impedance of the running lamps now shunts the capacitor Cign. The resonant action of capacitor Cign and L is highly damped as a result. The extent of the damping is such that the presence of capacitor Cign can be largely ignored once the lamp is running. When the lamp is running in a steady state it is lit and producing light in an efficient manner.

Figure 13:
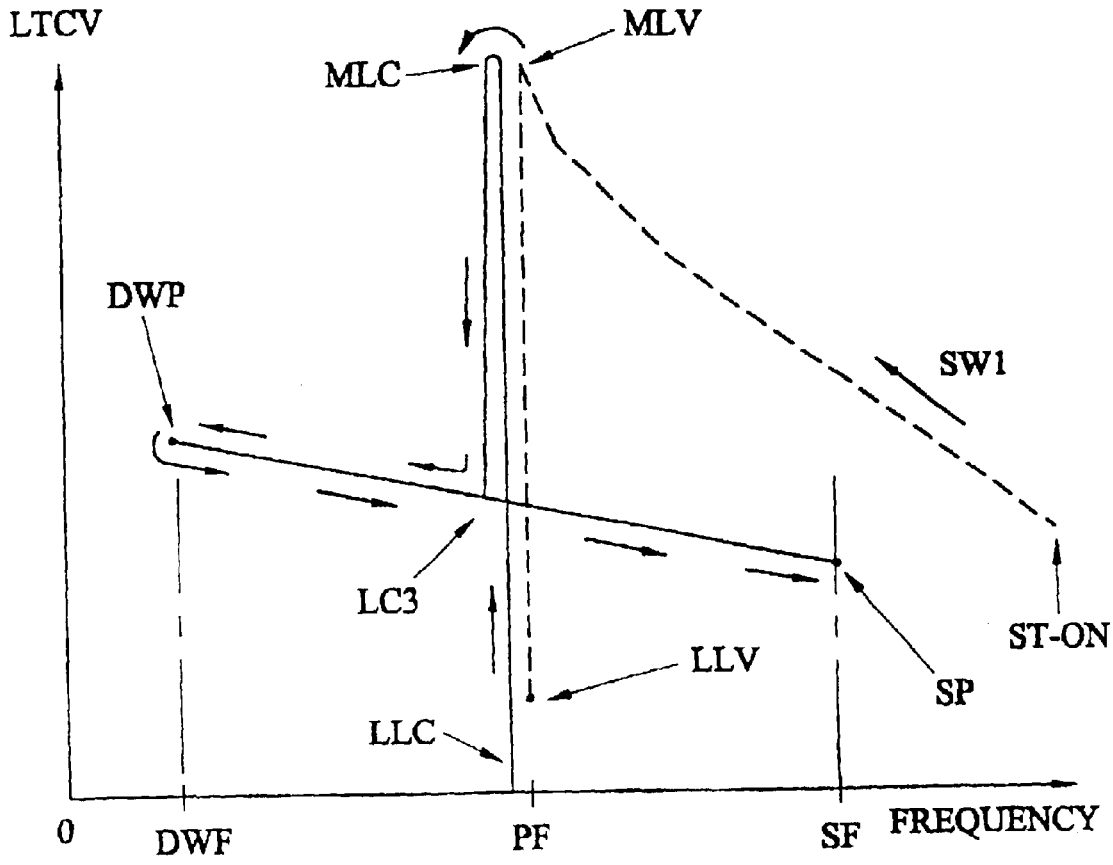
FIG. 13 is a graph of a relationship between a voltage across a lamp of the embodiment shown in FIG. 9 before it is lit and up to the instant that it is lit with the frequency of an electrical supply across the lamp, and of a relationship between the said frequency and a current through the lamp from the instant it is lit and begins to conduct.

Such a variation of voltage and current with frequency as the lamp is switched on and starts to become lit and continues lit can be seen from FIG. 13. In FIG. 13 a combined graph of both voltage and current LTCV is plotted against frequency FREQ. Such a graph may be obtained from a circuit such as that shown in FIG. 9, where the circuit also comprises a variable frequency generator. In operation when the circuit of FIG. 9 is switched on the variable frequency alternating current power output regulator 940 may be preferably arranged so that it starts operation at a high frequency at a start point ST-ON. The variable frequency alternating current power output regulator 940 may be arranged to then reduce the frequency so that a voltage measured across terminals of each lamp follows the arrow SW1. The voltage rises to a maximum lamp voltage MLV at a particular frequency PF at which point the lamp resistance breaks down and the lamps suddenly begins to conduct. The voltage across the lamps immediately collapses from the maximum lamp voltage value MLV to a low value LLV. The voltage is no longer shown on this graph, as it now varies with time rather than with frequency. However, a lamp current LLC begins to flow through the lamps at the instant the lamps begin to conduct. Note that for clarity there is a gap shown on the graph. The lamp current rises substantially instantaneously to a maximum value MLC and then falls rapidly to a point LC3 as the variable frequency alternating current power output regulator 940 continues to reduce the frequency of the voltage across the lamp. As the frequency continues to fall the current rises to a second maximum at a dwell point DWP. Preferably the variable frequency alternating current power output regulator 940 is arranged to dwell for a considerably longer period than a sweep time that has elapsed between the start point ST-ON and the dwell point DWP. A benefit of the dwell period is that the discharge in the lamp is allowed to stabilise at the higher second maximum current before the variable frequency generator increases the frequency to a sustained operation point SP. When the variable frequency alternating current power output regulator 940 is operating at the sustained operation point frequency SF the lamp is operating so as to produce light in an efficient manner.

It is advantageous, in order to prolong lamp life, to ensure that the lamp spends as little time as possible in the glow mode of operation. Preferably the values chosen for L and C, such as those given in Table 1, in conjunction with other design features present in the embodiment of the invention, provide for a high current to be driven through the lamp whilst it is in the glow mode. A benefit of this is that the glow to arc transition period is minimised.

Once the arc mode has become established the lamp presents low impedance to the passage of current through it. Initially, at start up, this impedance will be very low. As the lamp warms up towards its final operating temperature, the pressure of the lamp fill increases. This brings about corresponding increases in lamp impedance and lamp voltage during the warm up period.

As the current flowing through the lamp is determined primarily by the series reactance of L and C and the frequency of the alternating current power output regulator 940, the frequency of the alternating current power output regulator 940 may be adjusted to a minimum value so as to obtain appropriate values of run up current and then adjusted to provide a required steady state lamp current.

It will be noted that, when the lamp is running, lamp current flows through the series connected components L and C. Dependent upon the frequency of operation chosen, three distinct modes of circuit operation exist.

FIGS. 11 and 12 show graphically the lamp current, frequency and phase angle considerations These three distinct modes are:

1. Where the operating frequency is above the series resonant frequency of L and C, the current drawn from the alternating current power output regulator will lag the alternating current power output regulator voltage by some phase angle, i.e. the alternating current power output regulator sees an inductive load.
2. Where the operating frequency is below the series resonant frequency of L and C, the current drawn from the alternating current power output regulator will lead the alternating current power output regulator voltage by some phase angle, i.e. the alternating current power output regulator will see a capacitive load.
3. Where the operating frequency is set at the series resonant frequency of L and C the lamp current will be essentially unlimited, as the overall impedance of the supply circuit formed by the alternating current power output regulator and the components L and C will be at a minimum. The alternating current power output regulator will see an essentially resistive load in this mode of operation.

Clearly the third mode of operation is not directly useful, since it is the object of any practical ballast to limit lamp current to some known and controllable value. Limiting the output frequency range of the alternating current power output regulator is a practical means of ensuring that lamp operation is only possible at frequencies usefully above the series resonant frequency of L and C, that is operation preferably is constrained to mode 1.

By so limiting the output frequency range of the alternating current power output regulator 940 to frequencies above the series resonant frequency of L and C, it is ensured that:

1. Lamp current is controllable and follows some inverse function of alternating current power output regulator frequency.
2. The alternating current power output regulator is caused only to operate with an inductive load present at its output.

Both of these conditions are met in, but are not necessary to, a practical embodiment of the invention, which utilises frequency control as the primary means of regulating lamp current (and therefore lamp power) to some chosen value.

It should also be noted, as a benefit, that any DC component of voltage present at the output of the alternating current power output regulator will be blocked from reaching the lamp by the action of the capacitor C. In addition any tendency of the lamp to act as a rectifier will not result in a DC component of current flowing in the lamp. A benefit of this feature is that of preventing premature lamp failure or damage to the ballast circuit.

A further benefit of capacitor C and the high frequency being above 400 kHz, is that the value of capacitor C is sufficiently small to prevent a hazard from a supply frequency current that could otherwise be present at lampholder terminals. Preferably the maximum current at the supply frequency is below a value which would present a hazard to persons who might come into contact with the lamp terminals. Preferably this value is less than 30 mA, and more preferably less than 5 mA.

What is claimed is:

1. A lighting system comprising at least:

(a) a plurality of high intensity discharge lamps, each of the high intensity discharge lamps comprising a sealed envelope containing at least a first and a second electrode for an electrical discharge, (b) the lamps having an acoustic resonant frequency range, (c) an electronic control comprising a ballast and an ignitor, the ignitor having an ignition capacitance in a parallel circuit path with the lamps, the ignition capacitance being arranged in a resonant circuit having a fundamental resonant frequency, and having a power input, an alternating current power output regulator, and an alternating power output having an output frequency arranged to be variable within an output frequency range, the output having a first and a second output line, (d) the lamps being connected in series with each other so that the first line is connected to the first electrode of the first of the lamps, the second electrode of the first of the lamps is connected to the first electrode of the next lamp in the series, the second electrode of the final lamp in the series being connected to the second output line; and (e) the output frequency range being above the acoustic resonant frequency range.

2. A lighting system as in claim 1, wherein the regulated alternating current power output for powering the lamps has an output frequency greater than a frequency of a power supply to the ballast.

3. A lighting system as claimed in claim 1, wherein the control is provided with a switch to disconnect the ignition capacitance when the lamps are lit.

4. A lighting system as claimed in claim 1, wherein the ignition capacitance is arranged to resonate at the fundamental frequency when a particular output frequency within the output frequency range is at a third harmonic of the fundamental frequency.

5. A lighting system as claimed in claim 1, wherein a portion of the ignition capacitance is in a parallel current path separately with each lamp.

6. A lighting system as claimed in claim 1, wherein a resistor is connected in parallel with each lamp.

7. A lighting system as claimed in claim 1, wherein the control has a direct current to alternating current converter producing the regulated alternating current power output for powering the lamps, the control having an output frequency range greater 300 kHz.

8. A lighting system as claimed in claim 1, wherein the output frequency range is above 400 kHz.

9. A lighting system as claimed in claim 1, wherein the output frequency range is entirely above the upper limit frequency of the acoustic resonant frequency range of the lamps.

10. A lighting system as claimed in claim 1, wherein the alternating current output has a sinusoidal waveform.

11. A lighting system comprising at least:

(a) a plurality of high intensity discharge lamps, each of the high intensity discharge lamps comprising a sealed envelope containing at least a first and a second electrode for an electrical discharge, (b) the lamps having an acoustic resonant frequency range, (c) an electronic control having a power input, an alternating current power output regulator, and an alternating power output having an output frequency arranged to be variable within an output frequency range, the output having a first and a second output line, (d) the lamps being connected in series with each other so that the first line is connected to the first electrode of the first of the lamps, the second electrode of the first of the lamps is connected to the first electrode of the next lamp in the series, the second electrode of the final lamp in the series being connected to the second output line, and (e) the output frequency range being above the acoustic resonant frequency range;

wherein the control is arranged to monitor a mid-point voltage level between an adjacent pair of lamps.

12. A lighting system as claimed in claim 11, wherein the control is arranged to power down when a measured value of the midpoint voltage level is outside a permissible range of values.

13. A lighting system as claimed in claim 12, wherein the control has indicator means arranged to indicate which of the lamps has the lower arc voltage.

14. A lighting system as claimed in claim 12, wherein the control has indicator means arranged to indicate which of the lamps has the higher arc voltage.

15. A lighting system as claimed in claim 12, wherein the control has indicator means arranged to indicate a lamp with an arc voltage that is outside of an acceptable voltage lamp.

* * * * *